United States Patent [19]

Graham et al.

[11] Patent Number: 4,763,716

[45] Date of Patent: Aug. 16, 1988

[54] APPARATUS AND METHOD FOR USE IN CASTING ARTICLES

[75] Inventors: Lawrence D. Graham, Chagrin Falls; Daniel G. Fetsko, Lyndhurst; Thomas George, Euclid; Mark A. Crnkovic, Mentor; William D. James, Eastlake; Walter E. Merz, Richmond Heights, all of Ohio

[73] Assignee: PCC Airfoils, Inc., Cleveland, Ohio

[21] Appl. No.: 13,469

[22] Filed: Feb. 11, 1987

[51] Int. Cl.[4] ..... B22D 27/04

[52] U.S. Cl. ..... 164/122.1; 164/129; 164/338.1; 164/353

[58] Field of Search ..... 164/122, 122.1, 122.2, 164/125, 127, 129, 338.1, 350, 352, 353, 137, 339

[56] References Cited

U.S. PATENT DOCUMENTS

| | | | |
|---|---|---|---|
| 3,690,368 | 9/1972 | Copley et al. | 164/350 |
| 3,714,977 | 2/1973 | Terkelsen | 164/122.1 |
| 3,810,504 | 5/1974 | Piwonka | 164/122.1 |
| 4,673,021 | 6/1987 | Graham et al. | 164/122 |

FOREIGN PATENT DOCUMENTS

86/00166 1/1986 PCT Int'l Appl. .

*Primary Examiner*—Nicholas P. Godici
*Assistant Examiner*—Richard K. Seidel
*Attorney, Agent, or Firm*—Tarolli, Sundheim & Covell

[57] ABSTRACT

An improved apparatus and method is used to cast a plurality of articles in a mold structure having a plurality of article molds disposed in an array having an open central portion. The article molds are filled with molten metal while the mold structure is supported on a chill plate. An inner baffle plate is disposed in the central portion of the array of article molds and retards the transfer of heat from the article molds to the chill plate. The inner baffle plate is supported by a support structure which extends through the chill plate. After the article molds have been filled with molten metal, the chill plate and mold structure are lowered relative to the inner baffle plate to increase the rate of heat transfer from the article molds to the chill plate through the open central portion of the array of article molds. Thereafter, the inner baffle plate and support structure are lowered with the chill plate and mold structure. An outer baffle plate extends around the outside of the mold structure and is supported by the support structure. The outer baffle plate may be pressed against the bottom of a furnace to retard heat transfer between the inside and outside of the furnace along a path extending outside of the mold structure.

135 Claims, 4 Drawing Sheets

APPARATUS AND METHOD FOR USE IN CASTING ARTICLES

BACKGROUND OF THE INVENTION

The present invention relates to a new and improved apparatus and method for use in casting a plurality of articles in a mold structure which is lowered from a furnace.

A mold structure having a plurality of article molds disposed in an array with an open central portion and a gating system extending across an upper end of the open central portion of the array of article molds is disclosed in U.S. Pat. No. 3,690,368 issued Sept. 12, 1972 and entitled Casting Single Crystal Articles. This patent teaches that thermal gradients within a mold structure and the rate of solidification of molten metal can be controlled by surrounding the article molds with the metal which is being cast. The forming of the cavities which surround the article molds complicates the making of the mold structure. In addition, the filling of the cavities surrounding the article molds with molten metal increases the quantity of molten metal required to cast articles.

The use of a baffle plate to retard the transfer of heat from article molds is disclosed in U.S. Pat. No. 3,714,977 issued Feb. 6, 1973 and entitled Method and Apparatus for the Production of Directionally Solidified Castings. The baffle plate is in the form of an annular disk and has an inner edge which surrounds and closely fits the mold structure at a location adjacent to a chill plate upon which the mold structure is supported. When the chill plate and mold structure are lowered from a furnace, the baffle plate engages flanges connected with the furnace and remains stationary during continued lowering of the chill plate and mold structure.

A method and apparatus for use in casting a plurality of articles in a mold structure having a plurality of article molds disposed in an array with an open central portion is disclosed in U.S. Pat. No. 3,810,504 issued May 14, 1974 and entitled Method for Directional Solidification. The apparatus disclosed in this patent includes an annular chill plate. A baffle plate is disposed in a central portion of the array of article molds to retard the transfer of heat from the article molds to the chill plate. After the article molds have been filled with molten metal, the chill plate is lowered relative to the stationary baffle plate to withdraw the mold structure from a furnace. The baffle plate is supported by an inner heat sink which extends upwardly through the central portion of the annular chill plate to support the baffle plate during the pouring of molten metal into the mold structure and subsequent withdrawal of the mold structure from the furnace.

A mold structure having a plurality of article molds disposed in an array with an open central portion and having a gating system extending across an upper end of the open central portion of the mold structure is disclosed in Patent Cooperation Treaty International Application No. PCT/US86/00166 filed Jan. 28, 1986 and entitled Method and Apparatus for Casting Articles. This application discloses the concept of obtaining a large temperature gradient with a baffle plate which blocks the radiation of heat from the open central portion of the array of article molds as they are withdrawn from a furnace. The baffle plate is supported by a gating system which conducts molten metal to the article molds. The gating system is connected with a furnace so that during withdrawal of the article molds from the furnace, the baffle plate is supported in the central portion of the annular array of article molds.

SUMMARY OF THE PRESENT INVENTION

The present invention provides a new and improved method and apparatus for use in casting a plurality of articles in a mold structure having an open central portion. An inner baffle plate is disposed in the open central portion of the mold structure to retard the transfer of heat from the article molds to the chill plate. An outer baffle plate is disposed around the outside of the mold structure. Although it is preferred to use both inner and outer baffle plates, either baffle plate may be used by itself.

As the mold structure is withdrawn from a furnace, the mold structure and chill plate are lowered relative to a stationary baffle plate or plates. This causes a large temperature gradient to be established by a transfer of heat from the article molds through the open central portion of the mold structure to the chill plate. The stationary inner baffle plate retards transfer of heat through the open central portion of the mold structure. The stationary outer baffle plate may be pressed against a lower portion of the furnace to retard the transfer of heat around the outside of the mold structure.

During initial lowering of the chill plate and mold structure, the baffle plate or plates are supported by a stationary support structure which extends through the chill plate. After the mold structure and chill plate have been lowered to a position in which the baffle plate or plates are adjacent to upper end portions of the article molds, the baffle plate or plates and the support structure move downwardly with the chill plate. Thus, the baffle plate or plates and the support structure are stationary during an initial portion of the withdrawal of the mold structure from the furnace. During a final portion of the withdrawal of the mold structure from the furnace, the baffle plate or plates and the support structure move downwardly with the chill plate.

By supporting the inner baffle plate with a support structure which extends through the chill plate and allowing the inner baffle plate and its support structure to move downwardly with the chill plate after the mold structure has been partially withdrawn from the furnace, the supporting of the inner baffle plate and the construction of the mold structure are simplified. Thus, the inner baffle plate does not have to be supported by a support structure which extends through the mold structure to the furnace. Since the inner baffle plate and its support structure move downwardly with the chill plate after the mold structure has been partially withdrawn from the furnace, the mold structure can have a central gating system which extends across the upper end of the open central portion of the mold structure to promote an even distribution of molten metal to the various article molds.

Accordingly, it is an object of the present invention to provide a new and improved method and apparatus for use in casting a plurality of articles in a mold structure and wherein a baffle plate support structure extends through a chill plate to first hold a baffle plate stationary and then allow the baffle plate to be lowered with the chill plate and mold structure.

Another object of this invention is to provide a new and improved method and apparatus for use in casting a plurality of articles in a mold structure and wherein an outer baffle plate is held in engagement with the lower end portion of a furnace during lowering of the mold structure from the furnace.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 2:
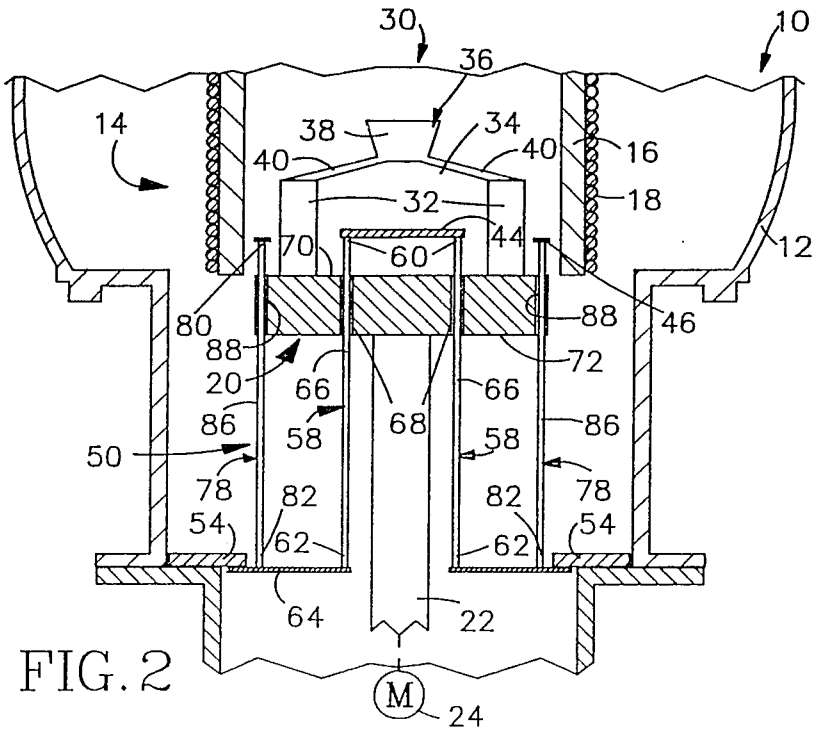
FIG. 2 is a schematic illustration, generally similar to FIG. 1, illustrating the relationship between the baffle plate and mold structure when the mold structure has been partially withdrawn from the furnace.

A casting apparatus 10 (FIG. 1) includes a fluid tight housing 12 which encloses an induction furnace 14 having a cylindrical susceptor housing 16 and an induction coil 18. A water cooled copper chill plate 20 is mounted on a cylindrical support post 22 and is movable vertically up and down relative to the furnace 14 and housing 12 by a reversible motor 24. The general construction of the housing 12 and furnace 14 is well known and may be similar to that shown in U.S. Pat. No. 3,841,384 issued Oct. 15, 1974 for Method and Apparatus for Melting and Casting Metal.

Figure 1:
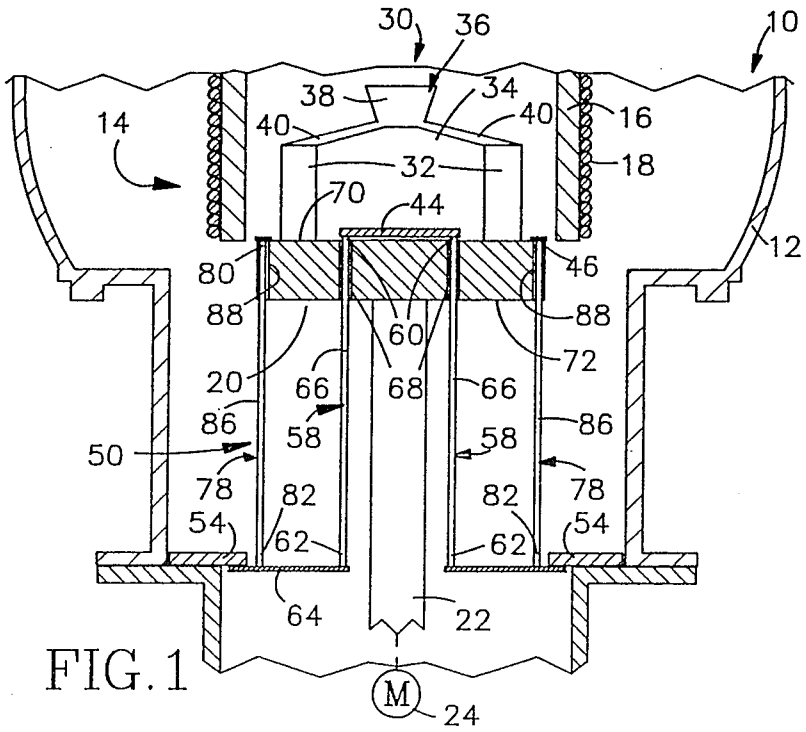
FIG. 1 is a schematic illustration depicting the relationship between a mold structure, baffle plate and furnace when the mold structure is entirely within the furnace.

A one piece ceramic mold structure 30 is supported on the circular chill plate 20. The mold structure 30 includes a plurality of article molds 32 disposed in an annular array about an open central portion 34. It should be understood that although only two article molds 32 are illustrated in FIG. 1, additional article molds are arranged in a circular array in a manner similar to that disclosed in Patent Cooperation Treaty Application No. PCT/US86/00166 filed Jan. 28, 1986 for Method and Apparatus for Casting Articles.

The one piece ceramic mold structure 30 includes a gating system 36 which extends across an upper end of the open central portion 34 of the array of article molds 32. The gating system 36 includes a pour cup 38 which is connected with each of the article molds 32 by a plurality of runners 40. The runners 40 extend radially outwardly from the pour cup in a manner similar to that disclosed in U.S. Pat. No. 3,680,625 issued Aug. 1, 1972 for Heat Reflector and U.S. Pat. No. 4,550,764 issued Nov. 5, 1985 for Apparatus and Method for Casting Single Crystal Articles.

A circular inner baffle plate 44 is disposed in the open central portion of the array of article molds 32 and an annular outer baffle plate 46 circumscribes the circular array of article molds. The inner and outer baffle plates 44 and 46 are disposed on the same level and retard the transfer of heat to the chill plate 20. Thus, the inner baffle plate 44 retards the transfer of heat from the article molds 32 through the open central portion 34 of the array of article molds to the chill plate 20. The annular outer baffle plate 46 retards the transfer of heat from the article molds 32 to the circular outer rim of the chill plate 20.

The baffle plates 44 and 46 can be made of any desired material, for example a heat insulating and/or reflecting material. If desired, only the inner baffle plate 44 may be used with the open center mold structure 30. If the mold structure 30 has a closed center construction, only the outer baffle plate 46 may be used.

In accordance with one of the features of the invention, the inner and outer baffle plates 44 and 46 are supported by a support structure 50 which extends through the chill plate 20. The support structure 50 supports the baffle plates 44 and 46 in a stationary relationship with the furnace housing 16 during an initial portion of the withdrawal of the mold structure 30 from the furnace 14. In accordance with another feature of the invention, during a final portion of withdrawal of the mold structure 30 from the furnace 14, the baffle plates 44 and 46 and support structure 50 move downwardly with the chill plate 20.

By having the inner baffle plate 44 move downwardly with the chill plate 20 during the final portion of the withdrawal of the mold structure 30 from the furnace, interference between the baffle plate 44 and gating system 36 is avoided. By having the support structure 50 extend upwardly through the chill plate 20, the support for the inner baffle plate 44 has a minimum of effect on the design of the mold structure 30. These two features allow the mold structure 30 and casting process to be designed to optimize the characteristics of the cast articles.

Baffle Support

The support structure 50 extends through the chill plate 20 to support the inner and outer baffle plates 44 and 46 in a stationary and coaxial relationship with the furnace 14 until the mold structure 30 has been partially withdrawn from the furnace 14. The baffle plates 44 and 46 and support structure 50 then move downwardly with the chill plate 20 as the withdrawal of the mold structure 30 from the furnace 14 is completed.

During withdrawal of the mold structure 30 from the furnace 14, the chill plates 44 and 46 cooperate with the mold structure to provide a relatively large temperature gradient between the inside and outside of the furnace. The inner baffle plate 44 promotes the obtaining of the relatively large temperature gradient by blocking radiation of heat from the portions of the article molds 32 above the inner baffle plate to the chill plate 20 and the outside of the furnace 14 through the open central portion 34 of the mold structure. Similarly, the outer baffle plate 46 promotes the obtaining of the relatively large temperature gradient by blocking the radiation of heat from the portion of the article molds disposed above the outer baffle plate to the chill plate 20 and the outside of the furnace. The use of the baffle plates 44 and 46 promotes the formation of horizontal isotherms with a relatively high temperature gradient for each unit length of portions of the article molds 32 as they are withdrawn from the furnace 14.

The support structure 50 holds the inner and outer baffle plates 44 and 46 stationary relative to the furnace 14 as the chill plate 20 and mold structure 30 are continuously lowered from the raised or pouring position of FIG. 1 to withdraw the mold structure 30 from the furnace 14. Thus, as the chill plate 20 is lowered from the raised or pouring position shown in FIG. 1 to the partially withdrawn position shown in FIG. 2, the support structure 50 holds the inner and outer baffle plates 44 and 46 stationary and at the same level. Therefore, as the mold structure 30 is lowered, the exposure of the lower portions of the article molds 32 to the chill plate 20 through the open central portion 34 of the mold structure increases. At the same time, the exposure of the lower portions of the article molds 32 to the periphery of the chill plate 20 and to the relatively cool portion of the housing 12 outside of the furnace housing 16 increases.

When the article molds 32 have been almost completely withdrawn from the furnace 14 (FIG. 4), the stationary inner and outer baffle plates 44 and 46 are disposed adjacent to the upper ends of the article molds 32. Therefore heat can be transferred throughout the length of the article molds to the chill plate 20 and the outside of the furnace 14. As the article molds 32 are withdrawn from the furnace 14, the molten metal in the article molds solidifies at a controlled rate to promote directional solidification of molten metal upwardly from a lower portion to an upper portion of the article molds with the formation of equiaxed, columnar grained or single crystal cast articles.

When the article molds 32 have been withdrawn from the furnace 14 (FIG. 4), the inner baffle plate 44 is disposed adjacent to the upper ends of the article molds and the gating system 36. During continued withdrawal of the mold structure 30 from the furnace 14, both the baffle plate 44 and support structure 50 are moved downwardly with the chill plate 20. This prevents interference between the inner baffle plate 44 and the gating system 36.

The baffle plate support structure 50 is initially held stationary by retainers 54 which are fixedly connected to the housing 12. Upon engagement of the inner baffle plate 44 with the gating system 36, the downward pressure applied against the baffle plate by the gating system is transmitted through the support structure 50 to the retainers 54. This force is sufficient to cause the retainers 54 to release the support structure 50.

Figure 4:
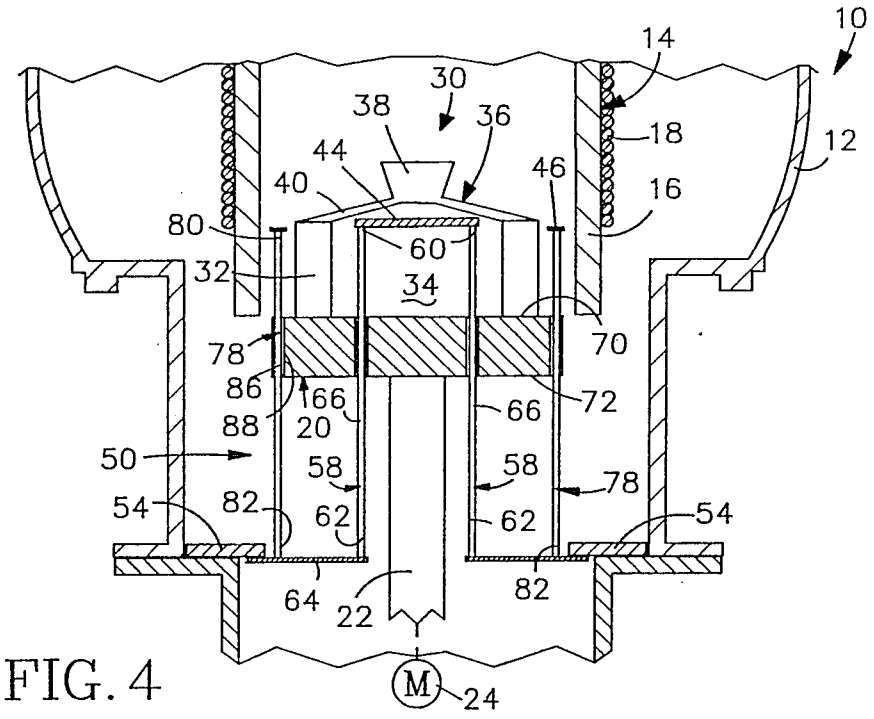
FIG. 4 is a schematic illustration, generally similar to FIG. 2, illustrating the relationship between the mold structure and baffle plate after the mold structure has been withdrawn from the furnace through a distance sufficient to bring the mold structure into engagement with the baffle plate.
Figure 5:
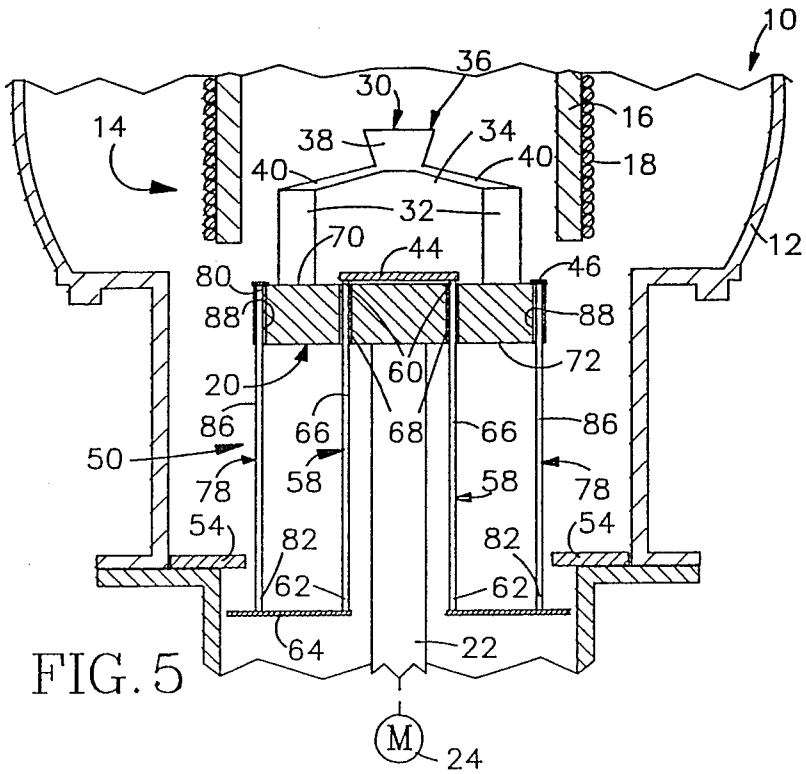
FIG. 5 is a schematic illustration, generally similar to FIG. 4, illustrating the relationship between the chill plate, mold structure and baffle plate after the chill plate and mold structure have been lowered through a short distance from the position shown in FIG. 4.

When the support structure 50 is released by the retainers 54, the support structure, inner baffle plate 44 and outer baffle plate 46 drop downwardly from the position shown in FIG. 4 to the position shown in FIG. 5. Downward movement of the baffle plates 44 and 46 results in the baffle plates moving from positions adjacent to the upper end portions of the article molds 32 to positions in which the baffle plates rest on the chill plate 20 and are disposed adjacent to the lower end portions of the article molds 32. During continued downward movement of the chill plate 20 from the position shown in FIG. 5, the baffle plates 44 and 46 and the support structure 50 move with the chill plate and mold structure 30. Bearings are provided between the lower end portion of the support structure 50 and post 22 to guide movement of the support structure.

If the baffle plates 44 and 46 are not fixedly connected to the support structure 50, downward movement of the support structure is not stopped by engagement of the baffle plates with the chill plate 20. With this construction, flexible straps may be connected with the chill plate 20 and support structure 50 to limit downward movement of the support structure relative to the chill plate. It is believed that the use of straps to limit downward movement of the support structure 50 will be preferred when the baffle plates 44 and 46 are formed of light weight pieces of insulating board which are not fixedly secured to the support structure.

The continuous downward movement of the chill plate 20 completely withdraws the mold structure 30 from the furnace 14 and lowers the mold structure to a position adjacent to the lower end of the fluid tight housing 12. A door (not shown) at the lower end portion of the housing 12 can then be opened and the mold structure 30 removed from the housing. When this occurs, the upper end of the mold structure 30 is below the retainers 54.

The baffle plate support structure 50 includes a plurality of vertical support rods 58 having upper end portions 60 which are fixedly connected to the inner baffle plate 44. The cylindrical support rods 58 have lower end portions 62 which are fixedly connected to an annular metal base plate 64 which engages the retainers 54. The cylindrical support rods 58 have intermediate portions 66 which extend upwardly from the lower end portions 62 of the support rods through vertical passages 68 in the chill plate 20 to the upper end portions 60 of the support rods. The support rods 58 have a length which is greater than the vertical distance through which the chill plate moves from the position shown in FIG. 1 to the position shown in FIG. 4. If desired, the upper end portions 60 of the support rods 58 could merely be disposed in abutting engagement with the baffle plate 44 rather than being fixedly secured to the baffle plate.

The cylindrical passages 68 in the chill plate 20 extend between a horizontal circular upper major side surface 70 (FIG. 3) of the chill plate 20 and parallel lower major side surface 72 of the chill plate 20. The support rods 58 are disposed in a circular array about the vertical central axis of the chill plate support post 22. The support rods 58 have longitudinal central axes which extend parallel to the longitudinal central axis of the support post 22 and which are coincident with the central axes of the passages 68 through the chill plate 20.

Figure 3:
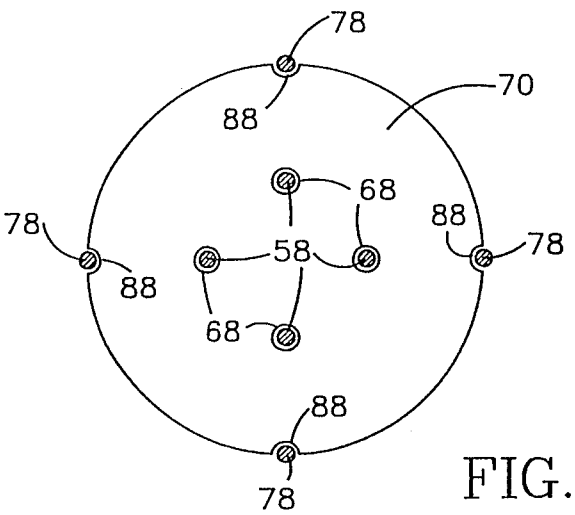
FIG. 3 is a top plan view of the chill plate of FIG. 1 and illustrating the relationship between a chill plate and a plurality of baffle plate support elements which extend through the chill plate.

The outer baffle plate 46 is supported by a plurality of vertical support rods 78 having upper end portions 80 which are fixedly connected to the outer baffle plate 46 and lower end portions 82 which are fixedly connected to the base plate 64. The cylindrical support rods 78 have intermediate portions 86 which extend through vertical passages or recesses 88 formed in the rim portion of the circular chill plate 20 (FIG. 3). The support rods 78 have longitudinal central axes which extend parallel to the central axes of the support rods 58 and post 22. The central axes of the support rods 78 are coincident with central axes of the passages 88 formed in the periphery of the chill plate 20. If desired, the upper end portions 80 of the support rods 78 could merely be disposed in abutting engagement with the outer baffle plate 46.

In the illustrated embodiment of the invention, the support structure 50 supports both the inner baffle plate 44 and outer baffle plate 46. It is contemplated that the support structure 50 could be constructed to support only one of the baffle plates 44 or 50 when only one baffle plate is to be used. Thus, if only the inner baffle plate 44 is required, the outer baffle plate 46 and its support rods 78 could be omitted. Similarly, if only the outer baffle plate 46 is required, the inner baffle plate 44 and its support rods 58 could be omitted.

Although it is contemplated that various types of retainers 54 could be used to hold the support structure 50 stationary relative to the furnace 14 until the gating system 36 engages the inner baffle plate 44, in one specific embodiment of the invention, the retainers were magnets. The magnets 54 magnetically engage the annular metal base plate 64 which is connected with the lower end portions 62 and 82 of the support rods 58 and 78. The magnetic retainers 54 hold the support structure 50 stationary during lowering of the chill plate 20 and mold structure 30 from the raised or pouring position of FIG. 1 to the partially withdrawn position of FIG. 4.

As the chill plate 20 moves downwardly along the intermediate portions 66 and 86 of the stationary support rods 58 and 78 from the position shown in FIG. 1 to the position shown in FIG. 4, the gating system 36 moves into engagement with the inner baffle plate 44. The force applied against the inner baffle plate 44 by the gating system 36 is transmitted to the support structure 50. This force is sufficient to disengage the annular metal base plate 64 from the magnetic retainers 54. When this occurs, the support structure 50 and inner and outer baffle plates 44 and 46 drop downwardly onto the chill plate 20, that is, from the position shown in FIG. 4 to the position shown in FIG. 5. At this time, the support structure 50 is supported by the baffle plates 44 and 46.

During continued downward movement of the chill plate 20 to completely withdraw the mold structure 30 from the furnace 14, the baffle plates 44 and 46 and support structure 50 move downwardly with the chill plate 20. Thus, prior to the releasing of the support structure 50 by the magnets 54, the mold structure 30 is moved downwardly relative to the stationary baffle plates 44 and 46 through a distance equal to the vertical height of the article molds 32. The mold structure 30, baffle plates 44 and 46 and support structure 50 are then moved downwardly with the chill plate 20 through a distance which is greater than the vertical height of the gating system 36. Although it is preferred to use magnets as retainer elements 54, it is contemplated that various known pressure responsive latch assemblies could be used if desired.

If only the outer baffle plate 46 was utilized, the mold structure 30 would be provided with projections which would engage the outer baffle plate 46. The force applied by these projections against the outer baffle plate 46 would disengage the base plate 64 from the magnetic retainer 54. When this occurs, the support structure 50 and outer baffle plate 46 would drop downwardly.

Although the illustrated support structure 50 includes a plurality of baffle plate support rods 58 and 78, it is contemplated that a single support rod 58 could be provided for the inner baffle plate 44 and a single outer support rod 78 could be provided for the outer baffle plate 46. Although it is preferred to simplify the construction of the mold structure 30 by having the baffle plates 44 and 46 supported independently of members extending through the array of article molds 32, it is contemplated that the outer baffle plate 46 and/or the inner baffle plate 44 could be supported by one or more elements extending radially through the annular array of article molds 32.

The foregoing description assumes that the inner and outer baffle plates 44 and 46 may be used either together or separately. However, it is believed that it will usually be preferred to use both the inner and outer baffle plates 44 and 46 together to maximize the thermal gradient between the inside and outside of the furnace 14 as the mold structure 30 is lowered. With the open center mold structure 30, it is believed that the inner baffle plate 44 will usually be necessary to obtain the desired thermal gradient.

In one specific preferred embodiment of the invention, the baffle plates 44 and 46 were formed of pieces of insulating board. This insulating board had a thickness of approximately 0.25 inches and was formed of graphite felt enclosed by layers of graphite foil. The insulating board is commercially available from Polycarbon, Inc. under the trade name Graphfoil. In this specific embodiment of the invention, the baffle plates 44 and 46 were not fixedly connected to the support structure 50 and downward movement of the support structure from the position of FIG. 4 to the position of FIG. 5 was limited by flexible straps connected between the support structure and chill plate 20.

Operation

When articles are to be cast in the mold structure 30, the mold structure is placed on the chill plate 20 while the chill plate is in a fully lowered position adjacent to the lower end of the housing 12. At this time, the baffle plates 44 and 46 are disposed in engagement with the chill plate 20 and the support structure 50 extends downwardly from the chill plate in the manner shown in FIG. 5.

The motor 24 is then operated to move the support post 22, chill plate 20, mold structure 30 and baffle support structure 50 upwardly in the housing 12. During this upward movement, the chill plate 20 and mold structure 30 move upwardly past the retainers 54 and enter the furnace 14. As the chill plate 20 approaches the raised position of FIG. 1, the metal base plate 64 of the support structure 50 is magnetically engaged by the retainers 54 and held in place.

The housing 12 is then sealed and evacuated. The induction coil 18 is then energized to preheat the mold structure 30 to a relatively high temperature, approximately 2,800° F. During preheating of the mold structure, the copper chill plate 20 is cooled by a flow of liquid through the chill plate. During preheating, the baffle plates 44 and 46 overlie the upper side surface 70 of the chill plate 20 to retard the transfer of heat from the article molds 32 to the chill plate.

Once the mold 30 has been preheated, molten metal is poured into the pour cup 38 and conducted through the runners 40 to the article molds 32. The molten metal fills the article molds and at least a portion of the runners 40.

In one specific instance, the molten metal was a nickel chrome super alloy and the article molds 32 had a configuration corresponding to the configuration of turbine blades. However, it should be understood that the apparatus and method of the present invention could be utilized to cast different articles out of different metals.

When the article molds 32 have been filled with molten metal and an equilibrium condition reached, the motor 24 is continuously operated to lower the support post 22 and chill plate 20. As the mold structure 30 is lowered with the chill plate 20, the lower end portions of the article molds 32 move downwardly past the stationary baffle plates 44 and 46 and are exposed to the central portion of the chill plate 20 (see FIG. 2). The baffle plates 44 and 46 retard the transfer of heat from the upper portions of the article molds 32 to the chill plate 20 at the outside of the furnace 14.

As the article molds 32 are gradually withdrawn from the furnace 14, a relatively large temperature gradient is established between the upper and lower end portions of the article molds. Therefore, the metal in the article molds 32 solidifies upwardly away from the chill plate 20 as the chill plate and mold structure 30 are lowered. However, the metal in the upper end portions of the article molds remains molten until the mold structure 30 is almost completely withdrawn from the furnace and the baffle plates 44 and 46 are adjacent to the upper end portions of the article molds (see FIG. 4).

The baffle plate support rods 58 and 78 and baffle plates 44 and 46 are held against axial movement by the retainers 54 as the chill plate 20 is lowered through a distance equal to the height of the article molds 32. Therefore, the support rods 58 and 78 have a length which is greater than the height of the article molds 32.

When the chill plate 20 and mold structure 30 have been lowered through a distance sufficient to move the gating system 36 into engagement with the stationary inner baffle plate 44 (FIG. 4), the molten metal in the article molds 32 will have solidified. Therefore, it is no longer necessary to use the baffle plates 44 and 46 to retard the transfer of heat from the article molds 32 to the chill plate 20 the outside of the furnace 14.

Continued downward movement of the chill plate 20 and the mold structure 30 from the intermediate position shown in FIG. 4 results in the application of downwardly directed forces against the inner baffle plate 44 by the gating system 36. These forces are transmitted from the inner baffle plate 44 to the support structure 50. The force is sufficient to overcome the attraction of the magnetic retainers 54 so that the support rods 58 move the base plate 64 away from the retainers. This releases the baffle plate support structure 50 for downward movement. The baffle plates 44 and 46 then drop downwardly onto the chill plate 20 (FIG. 5). Bearings are provided between the post 22 and support structure 50 to guide the downward movement of the support structure.

In the embodiment of the invention illustrated in FIGS. 1–5, the baffle plates 44 and 46 are fixedly connected to the support structure 50. Therefore, dropping the baffle plates 44 and 46 onto the chill plate 20 limits downward movement of the support structure 50. However, if desired, the baffle plates 44 and 46 could merely rest on the upper end portions 60 and 80 of the support rods 58 and 78. In such an embodiment of the invention, flexible straps would be used to limit downward movement of the support structure 50.

The chill plate 20 and mold structure 30 continue to be lowered by operation of the motor 24. This results in the support structure 50 and baffle plates 44 and 46 moving downwardly with the mold structure 30 as the mold structure is completely withdrawn from the furnace 14. Thus, once the baffle plates 44 and 46 have dropped down onto the chill plate 20, there is no relative movement between the chill plate and the baffle plates as the chill plate continues to be lowered. The mold structure 30 with the cast articles therein is subsequently withdrawn from the lower end of the housing 12. The baffle plates 44 and 46 may then be replaced or, preferably, reused with a next succeeding mold structure.

Although it is preferred to operate the motor 24 at a constant speed to continuously withdraw the mold structure 30 from the furnace 14 at a constant rate, the speed of operation of the motor could be varied if desired. Thus, the motor 24 could be operated at a relatively slow speed to move the mold structure 30 to the position shown in FIG. 5. Since the molten metal will have solidified in the article molds 32, the motor 24 can then be operated at a relatively high speed to complete the withdrawal of the mold structure 30 from the furnace 14.

In the embodiment of the invention shown in FIGS. 1–5 the inner baffle plate 44 has been shown as being a one-piece flat plate. However, it is contemplated that the baffle plate 44 could include a circular bottom plate and a layer of insulation on top of the bottom plate. This bottom plate may be secured to the support rods 58 or may merely rest on the support rods during downward movement of the chill plate 20.

Regardless of whether the baffle plate 44 is formed of one piece or a plurality of layers, the amount of heat insulation provided by the baffle plate 44 can be adjusted by varying the amount of insulation provided by the baffle plate to control the rate of heat transfer from the article molds 32 to the chill plate 20 during withdrawal of the mold structure 30 from the furnace 14. By constructing the baffle plate 44 to have the proper insulating effect, substantially horizontal solidification fronts can be obtained in the article molds 32 as the mold structure 30 is withdrawn from the furnace 14. Of course, the insulating effect of the outer baffle plate 46 could be varied in a similar manner to obtain the desired horizontal solidification fronts within the article molds 32. The establishment of a horizontal solidification front is advantageous when casting articles having many different crystallographic structures, including equiaxed, columnar grained, and single crystal structures.

Second Embodiment

In the embodiment of the invention illustrated in FIGS. 1–5, the magnetic retainers 54 release the baffle plate support structure 50 to enable the support structure and baffle plates 44 and 46 to drop downwardly from the position shown in FIG. 4 to the position shown in FIG. 5. It is contemplated that it may be desirable to eliminate the dropping of the baffle plate support structure 50 and baffle plates 44 and 46. In the embodiment of the invention illustrated in FIG. 6, retainers connect the baffle plate support structure with the chill plate after the mold structure has been partially withdrawn from the furnace 14 to prevent the baffle plate support structure from dropping. Since the embodiment of the invention illustrated in FIG. 6 is generally similar to the embodiment of the invention illustrated in FIGS. 1–5, similar numerals will be utilized to designate similar components, the suffix letter "a" being added to the numerals of FIG. 6 to avoid confusion.

Figure 6:
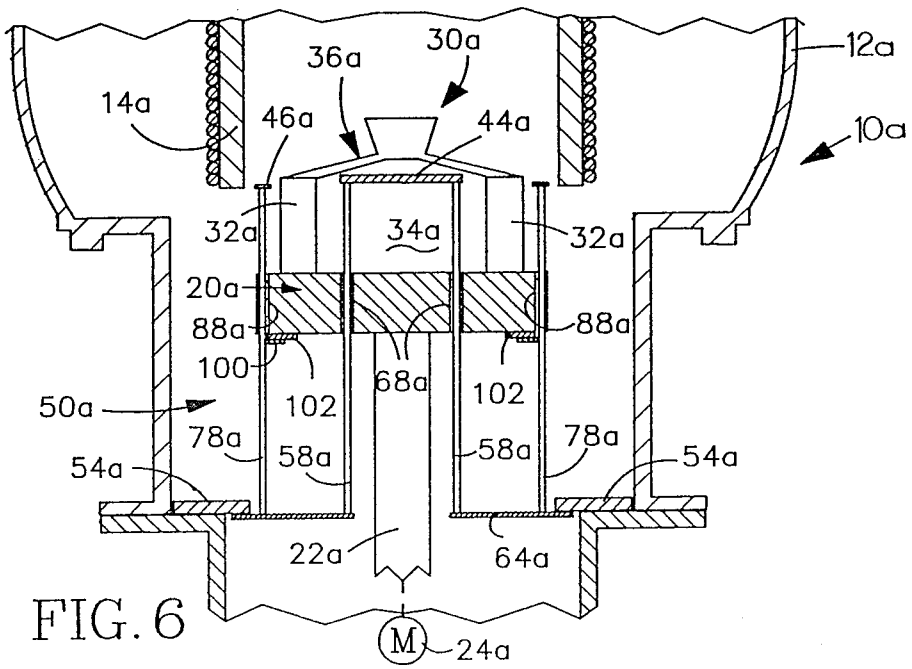
FIG. 6 is a schematic illustration of a second embodiment of the invention.

In the embodiment of the invention illustrated in FIG. 6, the casting apparatus 10a includes a fluid tight housing 12a which encloses an induction furnace 14a. A circular chill plate 20a is supported on a central post 22a which is movable vertically up and down by a motor 24a. A one piece mold structure 30a is supported on the chill plate 20a. The ceramic mold structure 30a includes an annular array of article molds 32a which extend around an open central portion 34a of the mold structure. A gating system 36a is connected with upper ends of the article molds 32a.

An inner baffle plate 44a is supported in the open central portion 34a of the mold structure 30a by a support structure 50a. An annular outer baffle plate 46a circumscribes an annular array of article molds 32a and is supported by the support structure 50a. The support structure 50a extends through passages 68a and 88a formed in the chill plate 20a.

The support structure 50a includes inner support rods 58a which support the inner baffle plate 44a and outer support rods 78a which support the outer baffle plate 46a. The support rods 58a and 78a are connected with an annular metal base plate 64a. The base plate 64a is magnetically engaged by retainers 54a which hold the support structure 50a stationary until the upper end portions of the article molds 32a have been moved downwardly to a position adjacent to the inner and outer baffle plates 44a and 46a.

When the upper end portions of the article molds 32a have moved to locations adjacent to the inner and outer baffle plates 44a and 46a and prior to engagement of the inner baffle plate 44a with the mold gating system 36a, an annular flange 100 interconnecting the outer support rods 78a engages magnetic retainer elements 102 connected with the chill plate 20a. At this time, the inner baffle plate 44a is spaced a small distance from the mold gating system 36a. Therefore, when the mold structure 30a is in the raised position, corresponding to the position of the mold structure 30 in FIG. 1, the flange 100 is spaced from the retainer elements 102 by a distance which is equal to the height of the article molds 32a.

Continued downward movement of the chill plate 20a from the partially lowered position shown in FIG. 6 results in the application of a downward force against the flange 100 by the magnetic retainers 102. This downward force overcomes the effect of the magnetic retainers 54a to release the base plate 64a.

When the base plate 64a is released, the baffle plate support structure 50a is held against dropping downwardly by the magnetic retainers 102 which engage the annular flange 100. Therefore, during continued downward movement of the chill plate 20a and mold structure 30a, the support structure 50a and baffle plates 44a and 46a are held stationary relative to the chill plate 20a by engagement of the flange 100 with the retainers 102. Thus, in the embodiment of the invention shown in FIG. 6, the mold structure 30a and chill plate 20a are lowered relative to the inner and outer baffle plates 44a and 46a until the baffle plates are adjacent to the upper end portions of the article molds 32a. The baffle plates 44a and 46a then remain adjacent to the upper end portions of the article molds 32a as the support structure 50a and mold structure 30a are lowered with the chill plate 20a to complete the withdrawal of the mold 30a from the furnace 14a.

Runouts

During use of either the embodiment of the invention shown in FIGS. 1 through 5 or the embodiment of the invention shown in FIG. 6, it is contemplated that there may be small runouts from the mold structure 30 during the casting of articles. If the molten metal from these small runouts flows along the upper side surface 70 of the chill plate 20 and enters the passages 68 through which the baffle plate support rods 58 extend, solidification of the molten metal may result in an innerconnection between the support rods 58 and the chill plate 20. Of course, this would prevent the desired relative movement between the chill plate 20 and baffle plate 44.

In order to retard the flow of molten metal along the upper major side surface 70 of the chill plate 20 to the passages 68 in the event of a small runout, each of the support rods 58 is circumscribed by an annular projection or collar 110 (FIG. 7) to keep the molten metal out of the passages through which the support rods 58 extend. In the embodiment of the invention illustrated in FIG. 7, the collar 110 is formed by a cylindrical tube which is received in a circular recess formed in the upper side 70 of the chill plate 20. However, the upwardly projecting collar 110 could be integrally formed as one piece with the chill plate 20 if desired.

When the chill plate 20 is in the raised position of FIG. 1, the lower side of the inner baffle plate 44 engages or is disposed immediately above the collars 110 surrounding the support rods 58. When the chill plate 20 is lowered to the position shown in FIG. 2, the inner baffle plate 44 is disposed a substantial distance above the collars 110.

Figure 7:
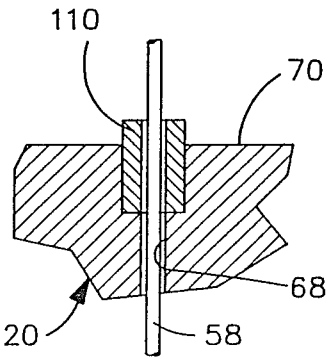
FIG. 7 is a fragmentary sectional view of an embodiment of the invention in which the chill plate has a collar which circumscribes a baffle plate support element.

Although only a single collar 110 has been shown circumscribing one of the support rods 58 in FIG. 7, it should be understood that the collars 110 are provided around each of the support rods 58. It is also contemplated that an annular collar, corresponding to the collar 110 will circumscribe each of the support rods 78 for the outer baffle plate 46 to prevent the flow of molten metal into the passages 88 through which the outer support rods 78 extend. Thus, a flow of molten metal along the flat upper major side surface 70 of the chill plate 20 into the passages 68 and 88 is blocked by projections similar to the projection 110 of FIG. 7. Although it is preferred to use annular collars 110 in association with the support rods 58 and 78, semicircular collars could be used in association with the support rods 78 if desired.

Outer Baffle Plate

In the embodiments of the invention illustrated in FIGS. 1–6, the annular outer baffle plate 46 has a circular peripheral surface which is disposed adjacent to and spaced slightly apart from the furnace housing or susceptor 16. This allows heat transfer to occur between the periphery of the outer baffle plate 46 and the furnace 14. In the embodiment of the invention illustrated in FIG. 8, the outer baffle plate engages the bottom of the furnace to retard a transfer of heat between the periphery of the outer baffle plate and the furnace. Since the embodiment of the invention illustrated in FIG. 8 is generally similar to the embodiment of the invention illustrated in FIGS. 1–6, similar numerals will be utilized to identify similar components, the suffix letter "b" being associated with the components of FIG. 8 to avoid confusion.

Figure 8:
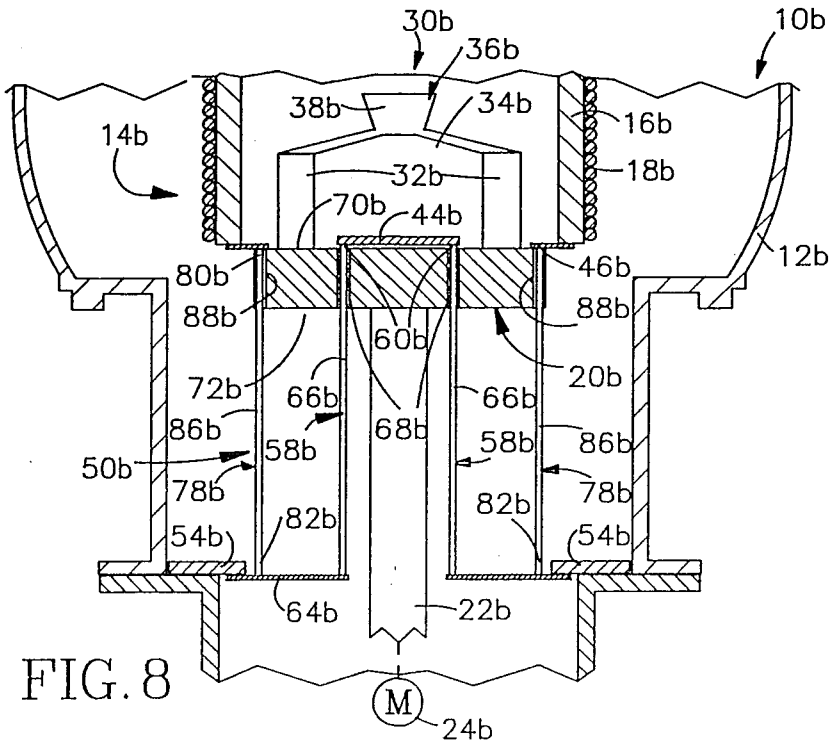
FIG. 8 is a schematic illustration of an embodiment of the invention in which an outer baffle plate engages a furnace to block heat transfer around a mold structure.

In the embodiment of the invention shown in FIG. 8, a casting apparatus 10b includes a fluid tight housing 12b which encloses an induction furnace 14b having a susceptor housing 16b and an induction coil 18b. A water cooled copper chill plate 20b is mounted on a cylindrical support post 22b and is movable vertically up and down relative to the furnace 14b and housing 12b by a reversible motor 24b.

A one piece ceramic mold structure 30b is supported on the circular chill plate 20b. A mold structure 30b includes a plurality of article molds 32b disposed in an annular array about an open central portion 34b. The one piece ceramic mold structure 30b includes a gating system 36b having a pour cup 38b.

A circular inner baffle plate 44b is disposed in the open central portion of the array of article molds 32b. An annular outer baffle plate 46b circumscribes the circular array of article molds 32b. The inner and outer baffle plates 44b and 46b are supported by a support structure 50b which extends through the chill plate 20b.

The support structure 50b supports the baffle plates 44b and 46b in a stationary relationship with the furnace housing 16b during an initial portion of the withdrawal of the mold structure 30b from the furnace 14b. During a final portion of the withdrawal of the mold structure 30b from the furnace 14b, the baffle plates 44b and 46b and support structure 50b move downwardly with the chill plate 20b in the same manner as previously described in conjunction with the embodiments of the invention illustrated in FIGS. 1–6.

In accordance with a feature of this embodiment of the invention, the outer baffle plate 46b engages the bottom of the furnace 14b to retard heat transfer between the inside and outside of the furnace. The outer baffle plate 46b has a flat annular upper surface which engages a flat annular lower surface of the susceptor housing 16b to block the transfer of heat around the outer rim or periphery of the baffle plate 46b.

When articles are to be cast in the mold structure 30b, the mold structure is placed on the chill plate 20b while the chill plate is in a fully lowered position. At this time, the baffle plates 44b and 46b are disposed in engagement with the chill plate 20b. The motor 24b is then operated to move the chill plate 20b, mold structure 30b and baffle plate support structure 50b upwardly in the housing 12b. As the chill plate 20b approaches the raised position shown in FIG. 8, the metal base plate 64b of the support structure 50b is magnetically engaged by the retainers 54b and held in place. At the same time, the upper surface of the outer chill plate 46b moves into abutting engagement with the lower surface of the susceptor housing 16b in the manner shown in FIG. 8.

After the housing 12 has been sealed and evacuated, the mold structure 30 is preheated. Molten metal is then poured into the pour cup 38b and fills the article molds 32b. The motor 24b is then continuously operated to lower the support post 22b and chill plate 20b. As the mold structure 30b is lowered with the chill plate 20b, the lower end portions of the article molds 32b move downwardly past the stationary baffle plates 44b and 46b.

The inner baffle plate 44b retards the transfer of heat from the portion of the article molds 32b in the furnace 14b to the central portion of the chill plate. The outer baffle plate 46b retards the transfer of heat from the portion of the article molds in the furnace to the rim of the chill plate and the relatively cool interior of the housing 12b. Since the outer baffle plate 46b is held in engagement with the bottom of the furnace 14b by the support structure 50b, the transfer of heat from the inside of the furnace 14b around the periphery of the outer baffle plate 46b is blocked.

When the chill plate 20b and mold structure 30b have been lowered through a distance sufficient to move the gating system 36b into engagement with a stationary inner baffle plate 44b, the molten metal in the article molds 32b will have solidified. The stationary outer baffle plate 46b is still disposed in engagement with the susceptor 16b.

Continued downward movement of the chill plate 20b and mold structure 30b applies force against the inner baffle plate 44b and support structure 50b to release the baffle plate support structure 50b for downward movement. The baffle plates 44b and 46b then drop downwardly onto the chill plate 20b. The chill plate 20b and mold structure 30b continue to be lowered by operation of the motor 24b in the manner previously explained in conjunction with the embodiment of the invention shown in FIG. 1–6.

In the embodiment of the invention shown in FIG. 8, the outer baffle plate 46b is used with an inner baffle plate 44b in association with an open center mold structure 30b. It is contemplated that the outer baffle plate 46b may be used in conjunction with mold structures which do not have an open center construction. Under these circumstances, the inner baffle plate 44b could be omitted. By having the outer baffle plate 46b engage the bottom of the furnace susceptor housing 16b, the establishment of a relatively large heat gradient between the inside of the furnace 14b and the outside of the furnace is promoted with either an open center or a closed center mold structure.

Conclusion

In view of the foregoing description it is apparent that the present invention provides a new and improved method and apparatus for use in casting a plurality of articles in a mold structure 30 having a plurality of article molds 32 disposed in an array with an open central portion 34. An inner baffle plate 44 is disposed in the open central portion 34 of the mold structure 30 to retard the transfer of heat from the article molds 32 to the chill plate 20 during preheating of the mold structure and pouring of molten metal into the mold structure. An outer baffle plate 46 is disposed around the outside of the mold structure 30. Although it is preferred to use both the inner and outer baffle plates 44 and 46, either baffle plate may be used by itself.

As the mold structure 30 is withdrawn from the furnace 14, the mold structure is lowered from a position (FIG. 1) in which the baffle plates 44 and 46 are adjacent to the lower end portion of the article molds 32 to a position (FIG. 4) in which the baffle plates are adjacent to the upper end portions of the article molds. The stationary inner baffle plate 44 retards the transfer of heat through the open central portion 34 of the mold structure 30. The stationary outer baffle plate 46 may be pressed against a lower end portion of the furnace 14 to retard the transfer of heat around the outside of the mold structure 30b (see FIG. 8).

During initial lowering of the chill plate 20 and mold structure 30, the baffle plate or plates 44 and/or 46 are supported by a stationary support structure 50 which extends through the chill plate 20. After the mold structure 30 and chill plate 20 have been lowered to a position in which the baffle plate or plates 44 and/or 46 are adjacent to the upper end portions of the article molds 32, the baffle plate or plates 44 and/or 46 and support structure 50 move downwardly with the chill plate 20. Thus, the baffle plates 44 and/or 46 and support structure 50 are stationary during an initial portion of the withdrawal of the mold structure 30 from the furnace 14. During a final portion of the withdrawal of the mold structure 30 from the furnace 14, the baffle plates 44 and/or 46 and support structure 50 move downwardly with the chill plate 20.

By supporting the inner baffle plate 44 with the support structure 50 which extends through the chill plate 20 and allowing the inner baffle plate and support structure to move downwardly with the chill plate after the mold structure 30 has been partially withdrawn from a furnace 14, the supporting of the inner baffle plate and the construction of the mold structure 30 are simplified. Thus, the inner baffle plate 44 does not have to be supported by a support structure which extends through the mold structure 30 to the furnace housing 16. Since the inner baffle plate 44 and its support structure 50 move downwardly with the chill plate 20 after the mold structure 30 has been partially withdrawn from the furnace, the mold structure can have a central gating system 36 which extends across the upper end of the open central portion 34 of the mold structure to promote an even distribution of molten metal to the various article molds 32.

Having described specific preferred embodiments of the invention, the following is claimed:

1. An apparatus for use in casting a plurality of articles in a mold structure having a plurality of article molds disposed in an array with an open central portion and having a gating system extending across an upper end of the open central portion of the array of article molds, said apparatus comprising furnace means for transmitting heat to the mold structure, movable chill plate means for receiving heat during casting of the articles and for supporting the mold structure, baffle plate means disposed in the central portion of the array of article molds for retarding the transfer of heat from the article molds to said chill plate means, motor means for lowering said chill plate means relative to said furnace means from a first position in which the mold structure is disposed in said furnace means to a second position and for lowering said chill plate means from the second position to a third position in which the mold structure is withdrawn from said furnace means, said baffle plate means being disposed adjacent to said chill plate means and lower end portions of the article molds when said chill plate means is in the first position to retard the transfer of heat from the article molds through the open central portion of the array of article molds to said chill plate means, said baffle plate means being spaced from said chill plate means and disposed adjacent to the gating system and upper end portions of the article molds when said chill plate means is in the second position to facilitate the transfer of heat from the article molds through the open central portion of the array of article molds to said chill plate means, said baffle plate means being disposed in open central portion of the array of article molds when said chill plate means is in the third position, support means extending through said chill plate means for supporting said baffle plate means, and retainer means for holding said support means and baffle plate means against movement relative to said furnace means with said chill plate means during movement of said chill plate means to the second position and for enabling said support means and baffle plate means to move relative to said furnace means with said chill plate means during movement of said chill plate means from the second position to the third position, said motor means being operable to lower said support means and baffle plate means with said chill plate means during movement of said chill plate means from the second position to the third position.

2. An apparatus as set forth in claim 1 wherein said support means includes a plurality of support elements having upper end portions in engagement with said baffle plate means at locations above said chill plate means during lowering of said chill plate means from the first position to the second position, lower end portions disposed below said chill plate means, and intermediate portions extending from said lower end portions through said chill plate means to said upper end portions, said chill plate means being movable along said intermediate portions of said support elements by said motor means.

3. An apparatus as set forth in claim 2 wherein said chill plate means includes surface means for defining a plurality of passages extending from a lower side surface of said chill plate means through said chill plate means to an upper side of said chill plate means, said support elements extending through the passages in said chill plate means.

4. An apparatus as set forth in claim 3 wherein said upper side of said chill plate means includes an upwardly facing major side surface and a plurality of projections extending upwardly from said major side surface, each of said projections at least partially circumscribing one of said support elements to retard a flow of material from said major side surface of said chill plate means into said passages.

5. An apparatus as set forth in claim 1 wherein said retainer means is operable under the influence of forces transmitted from said mold structure to said support means to release said support means for downward movement relative to said furnace means upon downward movement of said chill plate means from the second position.

6. An apparatus as set forth in claim 1 further including second baffle plate means disposed outside of the array of article molds for further retarding the transfer of heat from said article molds to said chill plate means, said support means supporting said second baffle plate means during downward movement of said chill plate means and article molds from the first position to the second position.

7. An apparatus as set forth in claim 1 wherein said support means includes a plurality of rods which extend through said chill plate means and have central axes which extend parallel to the direction of movement of said chill plate means and article molds under the influence of said motor means, said rods having a length which is greater than the distance between said first and second positions of said chill plate means.

8. An apparatus as set forth in claim 7 wherein said chill plate means includes a plurality of collars each of which at least partially circumscribes one of said rods to retard a flow of material along the one rod.

9. An apparatus as set forth in claim 1 further including housing means for enclosing said furnace means, chill plate means and article molds during the casting of articles, said retainer means connecting said support means with said housing means to hold said support means against movement during downward movement of said chill plate means and article molds from the first position to the second position.

10. An apparatus as set forth in claim 1 wherein said retainer means includes means for connecting said support means with said chill plate means upon movement of said chill plate means from the first position to the second position to prevent relative movement between said support means and chill plate means and to maintain said baffle plate means adjacent to the upper end portions of the article molds as said motor means lowers said chill plate means from the second position to the third position.

11. An apparatus as set forth in claim 1 further including second baffle plate means disposed outside of the array of article molds for further retarding the transfer of heat from the article molds, said support means including means for holding said second baffle plate means in abutting engagement with said furnace means during movement of said chill plate means from the first position to the second position.

12. An apparatus as set forth in claim 11 wherein said chill plate means supports said second baffle plate means during downward movement of said chill plate means and article molds to the third position.

13. An apparatus for use in casting a plurality of articles, said apparatus comprising movable chill plate means for receiving heat during casting of the articles and for supporting a plurality of article molds in an array having an open central portion, said chill plate means including a plurality of passages extending through said chill plate means, baffle plate means disposed in the open central portion of the array of article molds for retarding the transfer of heat from the article molds to said chill plate means, a plurality of elongated and spaced apart support elements extending through said passages and having parallel longitudinal axes, each of said support elements having an upper end portion, a lower end portion disposed beneath said chill plate means, and an intermediate portion which extends through one of the passages in said chill plate means, and motor means for moving said chill plate means downwardly relative to said baffle plate means and along the intermediate portions of said support elements to increase the exposure of the array of article molds to said chill plate means, said upper end portions of said support elements engaging said baffle plate means at locations above said chill plate means to support said baffle plate means during downward movement of said chill plate means along the intermediate portions of said support elements.

14. An apparatus as set forth in claim 13 further including retainer means for holding said support elements and baffle plate means against downward movement with said chill plate means during movement of said chill plate means from a first position to a second position and for enabling said support elements and baffle plate means to move with said chill plate means during downward movement of said chill plate means from the second position to a third position.

15. An apparatus as set forth in claim 13 further including magnet means for magnetically holding said support elements and baffle plate means against movement with said chill plate means during movement of said chill plate means from a first position to a second position, said support elements being movable relative to said magnet means to disengage said support elements from said magnet means upon downward movement of said chill plate means from the second position.

16. An apparatus as set forth in claim 15 further including second magnet means for magnetically holding said support elements against movement relative to said chill plate means during downward movement of said chill plate means from the second position.

17. An apparatus as set forth in claim 13 further including an outer baffle plate means disposed outside of the array of article molds, said support elements supporting said outer baffle plate means during downward movement of said chill plate means and article molds.

18. An apparatus as set forth in claim 13 further including housing means for enclosing said chill plate means and article molds during the casting of articles, and retainer means for connecting said support elements with said housing means to hold said support elements against movement during downward movement of said chill plate means and article molds.

19. An apparatus as set forth in claim 13 wherein said chill plate means includes a plurality of collar means each of which extends upwardly from said upper side of said chill plate means and circumscribes one of said support elements for retarding a flow of molten metal from said upper side of said chill plate means into said passages.

20. An apparatus as set forth in claim 13 wherein said passages are disposed in an array in a central portion of said chill plate means.

21. An apparatus as set forth in claim 13 further including an outer baffle plate disposed outside of the array of article molds, said plurality of passages including a first group of passages extending through a central portion of said chill plate means and a second group of passages extending through a rim portion of said chill plate means, said plurality of support elements including a first group of support elements extending through the first group of passages and having end portions which engage said baffle plate means and a second group of support elements extending through the second group of passages and having upper end portions which engage said outer baffle plate.

22. An apparatus as set forth in claim 21 further including furnace means for transmitting heat to the mold structure, said second group of support elements including means for holding said outer baffle plate in abutting engagement with said furnace means during downward movement of said chill plate means.

23. An apparatus as set forth in claim 22 wherein said chill plate means includes a plurality of collar means each of which extends upwardly from said upper side of said chill plate means and circumscribes one of the support elements of said first group of support elements for retarding a flow of molten metal from said upper side of said chill plate means into the first group of passages.

24. A method of casting a plurality of articles, said method comprising the steps of providing a mold structure having a plurality of article molds disposed in an array with an open central portion and having a gating system connected in fluid communication with the article molds, supporting the mold structure on a movable chill plate, at least partially enclosing the mold structure with a housing, flowing molten metal into the gating system and conducting the molten metal to the article molds while the mold structure is supported on the chill plate, retarding heat transfer from the article molds to the chill plate with a baffle plate disposed in the central portion of the array of article molds and adjacent to lower end portions of the article molds after having performed said step of conducting molten metal to the article molds, thereafter, lowering the chill plate and mold structure relative to the housing and baffle plate to an intermediate position in which the baffle plate is adjacent to the gating system and upper end portions of the article molds to facilitate the transfer of heat from portions of the article molds disposed below the baffle plate to the chill plate, and thereafter, lowering the chill plate, mold structure and baffle plate together relative to the housing.

25. A method as set forth in claim 24 further including the step of transmitting force through the chill plate to support the baffle plate in a stationary relationship with the housing during lowering of the chill plate and mold structure to the intermediate position.

26. A method as set forth in claim 24 further including the step of supporting the baffle plate on a plurality of support elements which extend through the chill plate, utilizing a magnet to magnetically hold the support elements and baffle plate against downward movement with the chill plate during lowering of the chill plate to the intermediate position, and moving the support elements and baffle plate downwardly against the influence of the magnet during said step of lowering of the chill plate, mold structure and baffle plate together relative to the housing.

27. A method as set forth in claim 24 further including the step of applying force against the baffle plate with the mold structure to move the baffle plate downwardly during performance of said step of lowering the chill plate, mold structure and baffle plate together relative to the housing.

28. A method as set forth in claim 24 further including the step of maintaining the spatial relationship between the mold structure, baffle plate and chill plate constant during lowering of the chill plate, mold structure, and baffle plate from the intermediate position.

29. A method as set forth in claim 24 further including the step of lowering the baffle plate relative to the chill plate to a position in which the baffle plate is adjacent to the chill plate and lower end portions of the article molds after having performed said step of lowering the chill plate and mold structure to the intermediate position and prior to completion of said step of lowering the chill plate, mold structure and baffle plate together relative to said housing.

30. A method as set forth in claim 24 wherein completion of said step of lowering the chill plate and mold structure relative to the housing and baffle plate and said step of lowering the chill plate, mold structure and baffle plate together relative to the housing results in a lowering of the chill plate and mold structure relative to the housing through a distance which is greater than the distance from the top of the chill plate to the top of the mold structure.

31. A method as set forth in claim 30 wherein completion of said step of lowering the chill plate, mold structure and baffle plate together relative to the housing results in a lowering of the baffle plate relative to the housing through a distance which is greater than the distance from the bottom of the gating system to the top of the mold structure.

32. A method as set forth in claim 24 further including supporting the baffle plate above the chill plate and connecting the baffle plate to the chill plate for movement therewith during performance of said step of lowering of the chill plate, mold structure and baffle plate together.

33. A method as set forth in claim 24 further including dropping the baffle plate from a position adjacent to the gating system onto the chill plate after lowering the chill plate and mold structure to the intermediate position and prior to performance of said step of lowering the chill plate, mold structure and baffle plate together.

34. A method as set forth in claim 24 further including holding a second baffle plate which extends around the outside of the array of article molds in abutting engagement with the housing during performance of said step of conducting molten metal to the article molds, said step of lowering the chill plate and mold structure relative to the housing to the intermediate position including lowering the chill plate and mold structure relative to the second baffle plate until the second baffle plate is adjacent to the gating system and upper end portions of the article molds.

35. A method as set forth in claim 34 further including the step of transmitting force through the chill plate to support the second baffle plate in a stationary relationship with the housing during lowering of the chill plate and mold structure to the intermediate position.

36. A method as set forth in claim 34 further including the step of supporting the second baffle plate on a plurality of support elements which extend through the chill plate, and utilizing a magnet to magnetically hold the support elements and second baffle plate against downward movement with the chill plate during lowering of the chill plate to the intermediate position.

37. A method of casting a plurality of articles, said method comprising the steps of providing a mold structure having a plurality of article molds disposed in an array having an open central portion and a gating system extending across an upper end of the open central portion of the array of article molds, supporting the mold structure on a movable chill plate, flowing molten metal into the gating system and conducting the molten metal to the article molds while the mold structure is supported on the chill plate, providing a baffle plate in the central portion of the array of article molds, retarding the transfer of heat from the article molds to the chill plate with the baffle plate after having performed said step of conducting molten metal to the article molds, lowering the chill plate and mold structure relative to the baffle plate, supporting the baffle plate with a support structure, and, during further lowering of the chill plate and mold structure, moving the baffle plate by transmitting force from the mold structure to the support structure.

38. A method as set forth in claim 37 further including the steps of increasing the distance between the baffle plate and chill plate and then decreasing the distance between the baffle plate and chill plate during lowering of the chill plate and mold structure.

39. A method as set forth in claim 37 wherein said step of transmitting force from the mold structure to the support structure includes providing abutting engagement between the baffle plate and mold structure.

40. A method as set forth in claim 39 wherein the support structure extends through the chill plate and is moved downwardly by the abutting engagement between the baffle plate and mold structure.

41. A method as set forth in claim 37 further including the step of dropping the baffle plate from a position adjacent to the gating system onto the chill plate during lowering of the chill plate and mold structure.

42. A method as set forth in claim 37 wherein said step of lowering the chill plate and mold structure includes lowering the chill plate and mold structure through a distance which is greater than the distance from the top of the chill plate to the top of the mold structure.

43. A method as set forth in claim 37 wherein said step of supporting the baffle plate with the support structure includes transmitting force through the chill plate to support the baffle plate and maintain the baffle plate stationary during performance of said step of lowering the chill plate and mold structure.

44. A method as set forth in claim 43 further including the steps of lowering the chill plate, mold structure, baffle plate and support structure together after having performed said step of moving the baffle plate by transmitting force from the mold structure to the support structure.

45. A method as set forth in claim 43 wherein said step of transmitting force from the mold structure to the support structure includes pressing downwardly against the baffle plate with the mold structure to move the baffle plate and support structure.

46. A method of casting a plurality of articles, said method comprising the steps of providing a mold structure having a plurality of article molds disposed in an array having an open central portion, supporting the mold structure on a movable chill plate, flowing molten metal into the article molds while the mold structure is supported on the chill plate, providing a baffle plate in the central portion of the array of molds, retarding the transfer of heat from the article molds to the chill plate with the baffle plate after having performed said step of conducting molten metal to the article molds, supporting the baffle plate with a support which extends through the chill plate, lowering the chill plate and mold structure relative to the baffle plate and support, and thereafter, lowering the baffle plate and support with the chill plate and mold structure.

47. A method as set forth in claim 46 further including the step of connecting the support with the chill plate for movement therewith upon completion of said step of lowering the chill plate and mold structure, said step of lowering the baffle plate and support with the chill plate and mold structure being at least partially performed while the support is connected with the chill plate for movement therewith.

48. A method as set forth in claim 46 further including the step of maintaining the distance between the baffle plate and chill plate constant during performance of said step of lowering the baffle plate and support with the chill plate and mold structure.

49. A method as set forth in claim 48 further including the step of increasing the distance between the baffle plate and the chill plate during performance of said step of lowering the chill plate and mold structure.

50. A method as set forth in claim 46 wherein said step of lowering the baffle plate and support with the chill plate and mold structure includes supporting the baffle plate above the chill plate with the support.

51. A method as set forth in claim 46 further including the step of dropping the baffle plate from a position adjacent to upper end portions of the article molds onto the chill plate after lowering the chill plate and mold structure relative to the baffle plate and support and prior to performance of said step of lowering the baffle plate and support with the chill plate and mold structure.

52. An apparatus for use in casting a plurality of articles in a mold structure having an open central portion, said apparatus comprising furnace means for transmitting heat to the mold structure, movable chill plate means for receiving heat during casting of articles in the mold structure and for supporting the mold structure in said furnace means, movable inner baffle plate means disposed in the open central portion of the mold structure for retarding the transfer of heat from the mold structure to said chill plate means, a plurality of support elements for supporting said inner baffle plate means in the open central portion of the mold structure, motor means for lowering said chill plate means and mold structure relative to said inner baffle plate means and support elements while said inner baffle plate means is supported in the central portion of the mold structure in a stationary relationship with said furnace means by said support elements to at least partially withdraw the mold structure from said furnace means and increase the exposure of the mold structure to said chill plate means, said motor means being operable to lower said chill plate means, mold structure, inner baffle plate means and support elements together relative to said furnace means to further separate the mold structure from said furnace means while said inner baffle plate means remains in the open central portion of the mold structure.

53. An apparatus as set forth in claim 52 wherein said support elements extend through passages in said chill plate means, said chill plate means includes an upwardly facing major side surface and a plurality of projections extending upwardly from said major side surface, each of said projections at least partially circumscribing one of said support elements to retard a flow of material from said major side surface of said chill plate means into said passages.

54. An apparatus as set forth in claim 53 further including outer baffle plate means extending around the outside of the mold structure, same of said support elements extending through passages in said chill plate means into engagement with said outer baffle plate means, said passages and projections being disposed adjacent to the periphery of said chill plate means.

55. An apparatus as set forth in claim 52 further including retainer means for holding said support elements and inner baffle plate means against downward movement with said chill plate means during lowering of said chill plate means from a first position to a second position and for enabling said support elements and inner baffle plate means to move with said chill plate means during lowering of said chill plate means from the second position to a third position.

56. An apparatus as set forth in claim 52 further including magnet means for magnetically holding said support elements and inner baffle plate means against movement with said chill plate means during movement of said chill plate means from a first position to a second position, said support elements being movable relative to said magnet means to disengage said support elements from said magnet means upon downward movement of said chill plate means from the second position.

57. An apparatus for use in casting articles, said apparatus comprising furnace means for supplying heat, movable chill plate means for receiving heat during casting of the articles and for supporting a mold structure, motor means for lowering said chill plate means from a first position in which the mold structure is disposed within said furnace means to a second position, outer baffle plate means extending around the outside of the mold structure for retarding the transfer of heat from the mold structure, and support means extending through said chill plate means for supporting said outer baffle plate means in engagement with the furnace means during lowering of said chill plate means from the first position to the second position, said support means including an upper end portion which engages said outer baffle plate means during lowering of said chill plate means from the first position to the second position, a lower end portion disposed beneath said chill plate means, and an intermediate portion which extends through said chill plate means.

58. An apparatus as set forth in claim 57 wherein said motor means is operable to lower said chill plate means from the second position to a third position, said outer baffle plate means is movable with said chill plate means during downward movement of said chill plate means from the second position to the third position.

59. An apparatus as set forth in claim 57 wherein the mold structure includes a plurality of article molds disposed in an array having an open central portion said apparatus further including inner baffle plate means disposed in the central portion of the array of article molds for further retarding the transfer of heat from the article molds, said support means including means for supporting said inner baffle plate means in a stationary relationship with said furnace means during lowering of said chill plate means from the first position to the second position.

60. A method of casting a plurality of articles, said method comprising the steps of providing a mold structure, supporting the mold structure on a movable chill plate, raising the chill plate to move the mold structure into a furnace, moving an outer baffle plate which extends around the outside of the mold structure from a location spaced apart from the furnace to a location in which the outer baffle plate is in engagement with a lower portion of the furnace while performing said step of raising the chill plate to move the mold structure into the furnace, said step of moving an outer baffle plate into engagement with a lower portion of the furnace includes raising the outer baffle plate with the chill plate and mold structure, thereafter, transferring heat from the furnace to the mold structure, flowing molten metal into the mold structure, moving the chill plate and mold structure downwardly relative to the furnace and outer baffle plate, maintaining the outer baffle plate in engagement with the furnace during the downward movement of the chill plate and mold structure, and retarding the transfer of heat from the inside of the furnace to the outside of the furnace with the outer baffle plate during downward movement of the chill plate and mold structure.

61. An apparatus for use in casting a plurality of articles in a mold structure having a plurality of article molds disposed in an array with an open central portion, said apparatus comprising movable chill plate means for receiving heat during casting of the articles and for supporting the mold structure, said chill plate means having an upwardly facing major side upon which the mold structure is supported and which is beneath and extends across the open central portion of the array of article molds, baffle plate means disposed in the open central portion of the array of article molds for retarding the transfer of heat from the article molds to said chill plate means, means for lowering said chill plate means from a first position to a second position, said baffle plate means being disposed adjacent to lower end portions of the article molds and extending across the portion of the upwardly facing major side of said chill plate means which is beneath and extends across the open central portion of the array of article molds when said chill plate means is in the first position to retard the transfer of heat from the article molds through the open central portion of the array of article molds to said chill plate means, said baffle plate means being spaced from said chill plate means and disposed adjacent to upper end portions of the article molds when said chill plate means is in the second position to facilitate the transfer of heat from the article molds through the open central portion of the array of article molds to the portion of the upwardly facing major side of said chill plate means which is beneath and extends across the open central portion of the array of article molds, and support means extending through the portion of the upwardly facing major side of said chill plate which is beneath and extends across the open central portion of the array of article molds for supporting said baffle plate means during movement of said chill plate means to the second position.

62. An apparatus as set forth in claim 61 wherein said support means includes a plurality of support elements having upper end portions in engagement with said baffle plate means at locations above said chill plate means during lowering of said chill plate means from the first position to the second position, lower end portions disposed below said chill plate means, and intermediate portions extending from said lower end portions through said chill plate means to said upper end portions, said chill plate means being movable along said intermediate portions of said support elements by said motor means.

63. An apparatus as set forth in claim 62 wherein said chill plate means includes surface means for defining a plurality of passages extending from a lower side of said chill plate means through said chill plate means to an upper side of said chill plate means, said support elements extending through the passages in said chill plate means.

64. An apparatus as set forth in claim 63 wherein said upper side of said chill plate means includes a plurality of projections extending upwardly from said upwardly facing major side, each of said projections at least partially circumscribing one of said support elements to retard a flow of material from said upwardly facing major side of said chill plate means into said passages.

65. An apparatus as set forth in claim 61 further including second baffle plate means disposed outside of the array of article molds for further retarding the transfer of heat from said article molds to said chill plate means, said support means supporting said second baffle plate means during downward movement of said chill plate means and article molds from the first position to the second position.

66. An apparatus as set forth in claim 61 wherein said support means includes a plurality of spaced apart rods which extend through said chill plate means at a plurality of spaced apart locations and have central axes which extend parallel to the direction of movement of said chill plate means and article molds under the influence of said motor means.

67. An apparatus as set forth in claim 61 further including furnace means for transmitting heat to the mold structure, said motor means being operable to lower said chill plate means from the second position to a third position in which said mold structure is withdrawn from said furnace means.

68. An apparatus as set forth in claim 61 further including retainer means for holding said support means against movement with said chill plate means during movement of said chill plate means from the first position to the second position.

69. An apparatus as set forth in claim 61 further magnet means for magnetically holding said support means against movement with said chill plate means during movement of said chill plate means from the first position to the second position, said support means being movable against the influence of said magnet means to release said support means for downward movement upon downward movement of said chill plate means from the second position.

70. A method of casting a plurality of articles, said method comprising the steps of providing a mold structure, supporting the mold structure on a movable chill plate, raising the chill plate to move the mold structure into a furnace, moving an outer baffle plate which extends around the outside of the mold structure into engagement with a lower portion of the furnace while performing said step of raising the chill plate to move the mold structure into the furnace, said step of moving an outer baffle plate into engagement with a lower portion of the furnace includes raising the outer baffle plate with the chill plate and mold structure, thereafter, transferring heat from the furnace to the mold structure, flowing molten metal into the mold structure, moving the chill plate and mold structure downwardly relative to the furnace and outer baffle plate, maintaining the outer baffle plate in engagement with the furnace during the downward movement of the chill plate and mold structure, retarding the transfer of heat from the inside of the furnace to the outside of the furnace with the outer baffle plate during downward movement of the chill plate and mold structure, and moving the chill plate, mold structure and outer baffle plate downwardly relative to the furnace after a major portion of the mold structure has been moved out of the furnace by performance of said step of moving the chill plate and mold structure downwardly relative to the furnace and outer baffle plate.

71. A method as set forth in claim 70 further including the step of transmitting force through the chill plate to support the outer baffle plate in engagement with the furnace during performance of said step of moving the chill plate and mold structure downwardly relative to the furnace and outer baffle plate.

72. A method as set forth in claim 70 wherein the mold structure includes a plurality of article molds disposed in an array with an open central portion, said method further including the steps of retarding the transfer of heat from upper end portions of the article molds to the chill plate with an inner baffle plate disposed in the central portion of the array of article molds during downward movement of the chill plate and mold structure relative to the furnace and outer baffle plate.

73. A method as set forth in claim 72 further including the steps of moving the inner baffle plate downwardly relative to the furnace during performance of said step of moving the chill plate, mold structure and outer baffle plate downwardly relative to the furnace.

74. A method as set forth in claim 73 further including the step of transmitting force through the chill plate to support the inner and outer baffle plates in a stationary relationship with the furnace during performance of said step of moving the chill plate and mold structure downwardly relative to the furnace and outer baffle plate.

75. A method as set forth in claim 72 further including the step of applying force against the inner baffle plate with the mold structure to move the inner and outer baffle plates downwardly relative to the furnace after at least a major portion of each of the article molds has been moved out of the furnace by performance of said step of moving the chill plate and mold structure downwardly relative to the furnace and the outer baffle plate.

76. A method as set forth in claim 70 further including the step of supporting the outer baffle plate on a plurality of longitudinally extending support elements which extend through the chill plate during performance of said step of moving the chill plate and mold structure downwardly relative to the furnace and outer baffle plate, said step of moving the chill plate and mold structure downwardly relative to the furnace and outer baffle plate including moving the chill plate downwardly along the support elements.

77. A method of casting a plurality of articles, said method comprising the steps of providing a mold structure, supporting the mold structure on a movable chill plate, raising the chill plate to move the mold structure into a furnace, moving an outer baffle plate which extends around the outside of the mold structure into engagement with a lower portion of the furnace while performing said step of raising the chill plate to move the mold structure into the furnace, said step of moving an outer baffle plate into engagement with a lower portion of the furnace includes raising the outer baffle plate with the chill plate and mold structure, thereafter, transferring heat from the furnace to the mold structure, flowing molten metal into the mold structure, moving the chill plate and mold structure downwardly relative to the furnace and outer baffle plate, transmitting force through the chill plate to support the outer baffle plate in engagement with the furnace during performance of said step of moving the chill plate and mold structure downwardly relative to the furnace and outer baffle plate, maintaining the outer baffle plate in engagement with the furnace during the downward movement of the chill plate and mold structure, and retarding the transfer of heat from the inside of the furnace to the outside of the furnace with the outer baffle plate during downward movement of the chill plate and mold structure.

78. A method as set forth in claim 77 wherein the mold structure includes a plurality of article molds disposed in an array with an open central portion, said method further including the steps of retarding the transfer of heat from upper end portions of the article molds to the chill plate with an inner baffle plate disposed in the central portion of the array of article molds during downward movement of the chill plate and mold structure relative to the furnace and outer baffle plate.

79. A method as set forth in claim 78 further including the steps of moving the chill plate, article mold structure, outer baffle plate and inner baffle plate downwardly relative to the furnace after a major portion of each of the article molds has been moved out of the furnace by performance of said step of moving the chill plate and mold structure downwardly relative to the furnace and outer baffle plate.

80. A method as set forth in claim 79 further including the step of transmitting force through the chill plate to support the inner baffle plate in a stationary relationship with the furnace during performance of said step of moving the chill plate and mold structure downwardly relative to the furnace and outer baffle plate.

81. A method as set forth in claim 78 further including the step of applying force against the inner baffle plate with the mold structure to move the inner and outer baffle plates downwardly relative to the furnace after at least a major portion of each of the article molds has been moved out of the furnace by perfomance of said step of moving the chill plate and mold structure downwardly relative to the furnace and outer baffle plate.

82. A method as set forth in claim 77 wherein said step of moving the chill plate and mold structure downwardly relative to the furnace and outer baffle plate includes moving the mold structure from a first position in which the outer baffle plate is adjacent to a lower end portion of the mold structure to a second position in which the outer baffle plate is adjacent to an upper end portion of the mold structure, said method further including the steps of moving the chill plate, mold structure and outer baffle plate downwardly from the second position while maintaining the outer baffle plate adjacent to the upper end portion of the mold structure, said step of moving the chill plate, mold structure and outer baffle plate downwardly including moving the outer baffle plate out of engagement with the furnace.

83. A method as set forth in claim 77 wherein said step of moving the chill plate and mold structure downwardly relative to the furnace and outer baffle plate includes moving the mold structure to a position in which the outer baffle plate is adjacent to an upper end portion of the mold structure, said method further including dropping the outer baffle plate onto the chill plate after having performed said steps of moving the chill plate and mold structure downwardly while maintaining the outer baffle plate in engagement with the furnace, and thereafter, moving the chill plate, mold structure and outer baffle plate downwardly.

84. A method of casting a plurality of articles, said method comprising the steps of providing a mold structure having a plurality of article molds disposed in an array with an open central portion and a gating system which extends across an upper end of the open central portion of the array of article molds, supporting the mold structure on a movable chill plate, raising the chill plate to move the mold structure into a furnace, moving an outer baffle plate which extends around the outside of the mold structure into engagement with a lower portion of the furnace while performing said step of raising the chill plate to move the mold structure into the furnace, said step of moving an outer baffle plate into engagement with a lower portion of the furnace includes raising the outer baffle plate with the chill plate and mold structure, thereafter, transferring heat from the furnace to the mold structure, flowing molten metal into the mold structure, moving the chill plate and mold structure downwardly relative to the furnace and outer baffle plate, maintaining the outer baffle plate in engagement with the furnace during the downward movement of the chill plate and mold structure, retarding the transfer of heat from the inside of the furnace to the outside of the furnace with the outer baffle plate during downward movement of the chill plate and mold structure, and retarding the transfer of heat from upper end portions of the article molds to the chill plate with an inner baffle plate disposed in the central portion of the array of article molds during downward movement of the chill plate and mold structure relative to the furnace and outer baffle plate.

85. A method as set forth in claim 84 further including the steps of moving the chill plate, article mold structure, outer baffle plate and inner baffle plate downwardly relative to the furnace after a major portion of each of the article molds has been moved out of the furnace by performance of said step of moving the chill plate and mold structure downwardly relative to the furnace and outer baffle plate.

86. A method as set forth in claim 84 further including the step of transmitting force through the chill plate to support the inner and outer baffle plates in a stationary relationship with the furnace during performance of said step of moving the chill plate and mold structure downwardly relative to the furnace and outer baffle plate.

87. A method as set forth in claim 84 further including the step of applying force against the inner baffle plate with the mold structure to move the inner and outer baffle plates downwardly relative to the furnace after at least a major portion of each of the article molds has been moved out of the furnace by performance of said step of moving the chill plate and mold structure downwardly relative to the furnace and outer baffle plate.

88. A method as set forth in claim 84 wherein said step of moving the chill plate and mold structure downwardly relative to the furnace and outer baffle plate includes moving the mold structure from the first position in which the outer baffle plate is adjacent to a lower end portion of the mold structure to a second position in which the outer baffle plate is adjacent to an upper end portion of the mold structure, said method further including the steps of moving the chill plate, mold structure and outer baffle plate downwardly from the second position while maintaining the outer baffle plate adjacent to the upper end portion of the mold structure, said step of moving the chill plate, mold structure and outer baffle plate downwardly including moving the outer baffle plate out of engagment with the furnace.

89. A method as set forth in claim 84 further including the step of supporting the inner and outer baffle plates on a plurality of longitudinally extending support elements which extend through the chill plate during performance of said step of moving the chill plate and mold structure downwardly relative to the furnace and outer baffle plate, said step of moving the chill plate and mold structure downwardly relative to the furnace and outer baffle plate including moving the chill plate downwardly along the support elements.

90. A method as set forth in claim 84 wherein said step of moving the chill plate and mold structure downwardly relative to the furnace and outer baffle plate includes moving the mold structure to a position in which the inner and outer baffle plates are adjacent to an upper end portion of the mold structure, said method further including dropping the inner and outer baffle plates onto the chill plate after having performed said steps of moving the chill plate and mold structure downwardly while maintaining the outer baffle plate in engagement with the furnace, and, thereafter, moving the chill plate, mold structure and inner and outer baffle plates downwardly.

91. A method casting a plurality of articles, said method comprising the steps of providing a mold structure, supporting the mold structure on a movable chill plate, raising the chill plate to move the mold structure into a furnace, moving an outer baffle plate which extends around the outside of the mold structure into engagement with a lower portion of the furnace while performing said step of raising the chill plate to move the mold structure into the furnace, said step of moving an outer baffle plate into engagement with a lower portion of the furnace includes raising the outer baffle plate with the chill plate and mold structure, thereafter, transferring heat from the furnace to the mold structure, flowing molten metal into the mold structure, moving the chill plate and mold structure downwardly relative to the furnace and outer baffle plate, maintaining the outer baffle plate in engagement with the furnace during the downward movement of the chill plate and mold structure, retarding the transfer of heat from the inside of the furnace to the outside of the furnace with the outer baffle plate during downward movement of the chill plate and mold structure, said step of moving the chill plate and mold structure downwardly relative to the furnace and outer baffle plate includes moving the mold structure from a first position in which the outer baffle plate is adjacent to a lower end portion of the mold structure to a second position in which the outer baffle plate is adjacent to an upper end portion of the mold structure, said method further including the steps of moving the chill plate, mold structure and outer baffle plate downwardly from the second position while maintaining the outer baffle plate adjacent to the upper end portion of the mold structure, said step of moving the chill plate, mold structure and outer baffle plate downwardly including moving the outer baffle plate out of engagement with the furnace.

92. A method of casting a plurality of articles, said method comprising the steps of providing a mold structure, supporting the mold structure on a movable chill plate, raising the chill plate to move the mold structure into a furnace, moving an outer baffle plate which extends around the outside of the mold structure into engagement with a lower portion of the furnace while perfoming said step of raising the chill plate to move the mold structure into the furnace, said step of moving an outer baffle plate into engagement with a lower portion of the furnace includes raising the outer baffle plate with the chill plate and mold structure, thereafter, transferring heat from the furnace to the mold structure, flowing molten metal into the mold structure, moving the chill plate and mold structure downwardly relative to the furnace and outer baffle plate, supporting the outer baffle plate on a plurality of longitudinally extending support elements which extend through the chill plate during performance of said step of moving the chill plate and mold structure downwardly relative to the furnace and outer baffle plate, said step of moving the chill plate and mold structure downwardly relative to the furnace and outer baffle plate including moving the chill plate downwardly along the support elements, maintaining the outer baffle plate in engagement with the furnace during the downward movement of the chill plate and mold structure, and retarding the transfer of heat from the inside of the furnace to the outside of the furnace with the outer baffle plate during downward movement of the chill plate and mold structure.

93. A method as set forth in claim 92 wherein said step of moving the chill plate and mold structure downwardly relative to the furnace and outer baffle plate includes moving the mold structure from a first position in which the outer baffle plate is adjacent to a lower end portion of the mold structure to a second position in which the outer baffle plate is adjacent to an upper end portion of the mold structure, said method further including the steps of moving the chill plate, mold structure and outer baffle plate downwardly from the second position while maintaining the outer baffle plate adjacent to the upper end portion of the mold structure, said step of moving the chill plate, mold structure and outer baffle plate downwardly including moving the outer baffle plate out of engagment with the furnace.

94. A method as set forth in claim 92 wherein said step of moving the chill plate and mold structure downwardly relative to the furnace and outer baffle plate includes moving the mold structure to a position in which the outer baffle plate is adjacent to an upper end portion of the mold structure, said method further including dropping the outer baffle plate onto the chill plate after having perfomed said steps of moving the chill plate and mold structure downwardly while maintaining the outer baffle plate in engagement with the furnace, and, thereafter, moving the chill plate, mold structure and outer baffle plate downwardly.

95. A method of casting a plurality of articles, said method comprising the steps of providing a mold structure, supporting the mold structure on a movable chill plate, raising the chill plate to move the mold structure into a furnace, moving an outer baffle plate which extends around the outside of the mold structure into engagement with a lower portion of the furnace while performing said step of raising the chill plate to move the mold structure into the furnace, said step of moving an outer baffle plate into engagement with a lower portion of the furnace includes raising the outer baffle plate with the chill plate and mold structure, thereafter, transferring heat from the furnace to the mold structure, flowing molten metal into the mold structure, moving the chill plate and mold structure downwardly relative to the furnace and outer baffle plate, maintaining the outer baffle plate in engagement with the furnace during the downward movement of the chill plate and mold structure, retarding the transfer of heat from the inside of the furnace to the outside of the furnace with the outer baffle plate during downward movement of the chill plate and mold structure, said step of moving the chill plate and mold structure downwardly relative to the furnace and outer baffle plate includes moving the mold structure to a position in which the outer baffle plate is adjacent to an upper end portion of the mold structure, said method further including dropping the outer baffle plate onto the chill plate after having performed said steps of moving the chill plate and mold structure downwardly while maintaining the outer baffle plate in engagement with the furnace, and, thereafter, moving the chill plate, mold structure and outer baffle plate downwardly.

96. An apparatus for use in casting a plurality of articles, said apparatus comprising movable chill plate means for receiving heat during casting of the articles and for supporting a plurality of article molds in an array having an open central portion, said chill plate means including a plurality of passages extending through said chill plate means, baffle plate means disposed in the open central portion of the array of article molds for retarding the transfer of heat from the article molds to said chill plate means, a plurality of support elements extending through said passages, and means for moving said chill plate means downwardly relative to said baffle plate means and said support elements, said support elements supporting said baffle plate means during at least a portion of the downward movement of said chill plate means.

97. An apparatus as set forth in claim 96 further including retainer means for holding said support elements and baffle plate means against downward movement with said chill plate means during movement of said chill plate means from a first position to a second position and for enabling said support elements and baffle plate means to move with said chill plate means during downward movement of said chill plate means from the second position.

98. An apparatus as set forth in claim 96 further including magnet means for magnetically holding said support elements and baffle plate means against movement with said chill plate means during movement of said chill plate means from a first position to a second position.

99. An apparatus as set forth in claim 96 further including an outer baffle plate means disposed outside of the array of article molds, said support elements supporting said outer baffle plate means during downward movement of said chill plate means and article molds.

100. An apparatus as set forth in claim 96 wherein each of said support elements has an upper end portion, a lower end portion disposed beneath said chill plate means, and an intermediate portion which extends through one of the passages in said chill plate means.

101. A method of casting a plurality of articles, said method comprising the steps of providing a mold structure having a plurality of article molds disposed in an array with an open central portion, supporting the mold structure on a movable chill plate, conducting molten metal into the article molds while the mold structure is supported on the chill plate, retarding heat transfer from the article molds to the chill plate with a baffle plate disposed in the central portion of the array of article molds and adjacent to lower end portions of the article molds, thereafter, lowering the chill plate and mold structure relative to the baffle plate to a position in which the baffle plate is adjacent to upper end portions of the article molds to facilitate the transfer of heat from portions of the article molds disposed below the baffle plate to the chill plate, and transmitting force through the chill plate to support the baffle plate during said step of lowering of the chill plate and mold structure.

102. A method as set fourth in claim 101 wherein said step of transmitting force through the chill plate to support the baffle plate includes the step of supporting the baffle plate on a plurality of spaced apart support elements which extend through the chill plate.

103. A method as set forth in claim 102 further including utilizing a magnet to magnetically hold the support elements and baffle plate against downward movement with the chill plate during lowering of the chill plate to the position in which the baffle plate is adjacent to upper end portions of the article molds, and, thereafter, moving the support elements and baffle plate downwardly against the influence of the magnet.

104. A method as set forth in claim 101 further including the step of applying force against the baffle plate with the mold structure to move the baffle plate downwardly.

105. A method as set forth in claim 101 further including the step of lowering the chill plate, mold structure and baffle plate together after having performed said step of lowering the chill plate and mold structure relative to the baffle plate to a position in which the baffle plate is adjacent to upper end portions of the article molds.

106. An apparatus for use in casting a plurality of articles in a mold structure having a plurality of article molds disposed in an array with an open central portion, said apparatus comprising movable chill plate means for receiving heat during casting of the articles and for supporting the mold structure, baffle plate means disposed in the central portion of the array of article molds for retarding the transfer of heat from the article molds to said chill plate means, motor means for lowering said chill plate means from a first position to a second position and for lowering said chill plate means from the second position, said baffle plate means being disposed adjacent to said chill plate means and lower end portions of the article molds when said chill plate means is in the first position to retard the transfer of heat from the article molds through the open central portion of the array of article molds to said chill plate means, said baffle plate means being spaced from said chill plate means and disposed adjacent to upper end portions of the article molds when said chill plate means is in the second position to facilitate the transfer of heat from the article molds through the open central portion of the array of article molds to said chill plate means, support means for supporting said baffle plate means, and magnet means for magnetically holding said support means and baffle plate means against movement with said chill plate means during lowering of said chill plate means from the first position to the second position and for releasing said support means and baffle plate means for movement with said chill plate means during lowering of said chill plate means from the second position.

107. An apparatus as set forth in claim 106 wherein said baffle plate means is disposed on a first side of said chill plate means and said magnet means is disposed on a second side of said chill plate means opposite from said first side of said chill plate means when said chill plate means is in the first position.

108. An apparatus as set forth in claim 106 wherein said chill plate means includes surface means for defining a plurality of passages extending from a lower side of said chill plate means through said chill plate means to an upper side of said chill plate means, said support means including a plurality of support elements which extend upwardly through the passages in said chill plate means.

109. An apparatus as set forth in claim 106 wherein said magnet means is releasable under the influence of forces transmitted from said mold structure to said support means to release said support means for downward movement with said chill plate means.

110. An apparatus as set forth in claim 106 further including second baffle plate means disposed outside of the array of article molds for further retarding the transfer of heat from said article molds to said chill plate means, said support means supporting said second baffle plate means during downward movement of said chill plate means and article molds from the first position to the second position, said magnet means being operable to magnetically hold said second baffle plate means against movement with said chill plate means during lowering of said chill plate means from the first postion to the second position and being operable to release said second baffle plate means for movement with said chill plate means during lowering of said chill plate means from the second position.

111. A method of casting a plurality of articles, said method comprising the steps of providing a mold structure having a plurality of article molds disposed in an array with an open central portion, supporting the mold structure on a movable chill plate, retarding heat transfer from the article molds to the chill plate with a baffle plate disposed in the central portion of the array of article molds and adjacent to lower end portions of the article molds, thereafter, lowering the chill plate and mold structure to an intermediate position in which the baffle plate is adjacent to the upper end portions of the article molds to facilitate the transfer of heat from portions of the article molds disposed below the baffle plate to the chill plate, thereafter, lowering the chill plate and mold structure from the intermediate position, utilizing magnet means to magnetically hold the baffle plate against movement with the chill plate during lowering of the chill plate and mold structure to the intermediate position, and moving the baffle plate against the influence of the magnet means during lowering of the chill plate and mold structure from the intermediate position.

112. A method as set forth in claim 111 wherein said step of lowering the chill plate and mold structure from the intermediate position includes lowering the baffle plate with the chill plate and mold structure.

113. A method as set forth in claim 111 wherein said step of lowering the chill plate and mold structure to an intermediate position includes lowering the chill plate and mold structure relative to the magnet means.

114. A method as set forth in claim 111 wherein said step of moving the baffle plate against the influence of the magnet means includes applying force to the baffle plate with the mold structure to move the baffle plate downwardly against influence of the magnet means.

115. A method as set forth in claim 111 wherein the magnetic means includes first and second elements being connected with the baffle plate, said step of moving the baffle plate against the influence of the magnet means to move the first element of the magnet means relative to the second element of the magnet means.

116. A method as set forth in claim 111 further including the step of transmitting force through the chill plate to support the baffle plate during lowering of the chill plate and mold structure to the intermediate position.

117. A method as set forth in claim 111 further including the step of supporting the baffle plate on a plurality of support elements which extend through the chill plate, said step of utilizing magnet means to magnetically hold the baffle plate against movement including utilizing a magnet to magnetically hold support elements and baffle plate against downward movement with the chill plate during lowering of the chill plate to the intermediate position, said step of moving the baffle plate against the influence of the magnet means including moving support elements and baffle plate downwardly against the influence of the magnet.

118. A method as set forth in claim 111 further including the step of maintaining the spatial relationship between the mold structure, baffle plate and chill plate constant during at least a portion of the lowering of the chill plate, mold structure, and baffle plate from the intermediate position.

119. A method as set forth in claim 111 further including the step of lowering the baffle plate relative to the chill plate to a position in which the baffle plate is adjacent to the chill plate and lower end portions of the article molds after having performed said step of lowering the chill plate and mold structure to the intermediate position and prior to completion of said step of lowering the chill plate and mold structure from the intermediate position.

120. A method as set forth in claim 111 further including the step of dropping the baffle plate from a position adjacent to the upper end portions of the article molds to a position adjacent to the lower end portions of the article molds after moving the baffle plate against the influence of the magnet means.

121. A method as set forth in claim 111 further including the steps of utilizing the magnet means to magnetically hold a second baffle plate around the outside of the array of article molds against movement with the chill plate during lowering of the chill plate and mold structure to the intermediate position, and moving the second baffle plate against the influence of the magnet means during lowering of the chill plate and mold structure from the intermediate position.

122. A method of casting a plurality of articles, said method comprising the steps of providing a mold structure having a plurality of article molds disposed in an array with open central portion, supporting the mold structure on a movable chill plate, retarding heat transfer from the article molds to the chill plate with a baffle plate disposed in the central portion of the array of article molds and adjacent to lower end portions of the article molds, thereafter, lowering the chill plate and mold structure to an intermediate position in which the baffle plate is adjacent to the upper end portions of the article molds to facilitate the transfer of heat from portions of the article molds disposed below the baffle plate to the chill plate, thereafter, lowering the chill plate and mold structure from the intermediate position, and dropping the baffle plate from a position adjacent to the upper end portions of the article molds to a position adjacent to the lower end portions of the article molds while performing said step of lowering the chill plate and mold structure from the intermediate position.

123. A method as set forth in claim 122 wherein said step of lowering the chill plate and mold structure from the intermediate position includes lowering the baffle plate with the chill plate and mold structure.

124. An apparatus for use in casting a plurality of articles, said apparatus comprising a plurality of article molds disposed in an array with an open central portion, furnace means for transmitting heat to said article molds, movable chill plate means for receiving heat during casting of articles in said article molds and for supporting said article molds in said furnace means, baffle means disposed in the open central portion of the array of article molds for retarding the transfer of heat from the array of article molds to said chill plate means, a plurality of spaced apart support elements extending from said baffle means to connect said furnace means with said baffle means to support said baffle means in the open central portion of the array of article molds, and means for moving said chill plate and article molds relative to said baffle means and support elements while said baffle means is supported in a stationary relationsip with said furnace means by said support elements to at least partially withdraw said article means from said furnace means and increase the exposure of said article molds to said chill plate means.

125. An apparatus as set forth in claim 124 wherein said support elements extend through said chill plate means.

126. A method of casting a plurality of articles, said method comprising the steps of supporting a plurality of article molds on a chill plate in an array with an open central portion, moving the article molds at least partially into a furnace chamber while the article molds are supported on the chill plate, conducting a flow of molten metal to the article molds while they are at least partially in the furnace chamber and supported on the chill plate, supporting a baffle from the furnace with the baffle disposed in the central portion of the array of article molds adjacent to lower end portions of the article molds to retard the transfer of heat from upper portions of the article molds to the chill plate, said step of supporting the baffle from the furnace including supporting the baffle with a plurality of spaced apart support elements which extend between the furnace and baffle, and thereafter, moving the article molds at least part way out of the furnace chamber, said step of moving the article molds out of the furnace chamber being at least partially performed with the support elements extending between the furnace and baffle.

127. A method as set forth in claim 126 further including the step of teminating the step of supporting the baffle from the furnace after the article molds have been moved at least part way out of the furnace chamber and with the baffle adjacent to upper end portions of the article molds.

128. A method as set forth in claim 127 wherein said step of terminating the supporting of the baffle from the furnace includes disconnecting the support elements from the furnace.

129. A method as set forth in claim 127 wherein said step of terminating the supporting of the baffle from the furnace includes pressing downwardly against the baffle with a gating system connected in fluid communication with the article molds.

130. A method of casting a plurality of articles, said method comprising the steps of supporting a plurality of article molds on a chill plate in an array with an open central portion, supporting a baffle with the chill plate and with the baffle disposed in the open central portion of the mold structure, moving the article molds at least partially into a furnace chamber while the article molds and baffle are supported by the chill plate, conducting a flow of molten metal to the article molds while they are at least partially in the furnace chamber and supported on the chill plate, supporting the baffle from the furnace with the baffle disposed in the open central portion of the array of article molds and adjacent to lower end portions of the article molds to retard the transfer of heat from upper portions of the article molds to the chill plate, said step of supporting the baffle from the furnace including connecting the support elements with the furnace, thereafter, moving the article molds at least part way out of the furnace chamber, and terminating the step of supporting the baffle from the furnace after the article molds have been moved at least part way out of the furnace chamber and with the baffle adjacent to upper end portions of the article molds by disconnecting the support elements from the furnace.

131. A method as set forth in claim 130 wherein said step of connecting the support elements with the furnace includes magnetically connecting the support elements with the furnace.

132. A method as set forth in claim 130 wherein said step of disconnecting the support elements from the furnace includes moving the chill plate, baffle, support elements and article molds downwardly together.

133. A method as set forth in claim 130 wherein said step of supporting the baffle with support elements includes supporting the baffle with the support elements extending through the chill plate.

134. A method as set forth in claim 130 further including dropping the baffle downwardly toward the chill plate after having performed said step of disconnecting the support elements from the furnace.

135. A method as set forth in claim 130 wherein said step of disconnecting the support elements from the furnace includes transmitting downwardly directed force from the mold structure to the support elements.

* * * * *